US005775191A

United States Patent [19]

Burton et al.

[11] Patent Number: 5,775,191

[45] Date of Patent: Jul. 7, 1998

[54] FOLDING AND SEWING APPARATUS

[76] Inventors: Perry E. Burton, 217 Marked Beech Rd., Marietta, S.C. 29661; John V. Noonan, 106 Merrifield Ct., Greenville, S.C. 29615

[21] Appl. No.: 747,579

[22] Filed: Nov. 12, 1996

Related U.S. Application Data

[63] Continuation of Ser. No. 250,797, May 27, 1994, Pat. No. 5,572,940.

[51] Int. Cl.[6] ..... B26D 1/06

[52] U.S. Cl. ..... 83/488; 83/562; 83/614; 83/627

[58] Field of Search ..... 83/613, 614, 623, 83/627, 628, 561, 562, 567, 487, 488

[56] References Cited

U.S. PATENT DOCUMENTS

| | | | |
|---|---|---|---|
| 3,204,500 | 9/1965 | Lincoln | 83/488 |
| 3,807,262 | 4/1974 | Vits | 83/342 |
| 4,069,729 | 1/1978 | Kuts | 83/488 |
| 4,355,794 | 10/1982 | Costigan | 83/487 |
| 5,066,352 | 11/1991 | Albers et al. | 83/694 |
| 5,327,805 | 7/1994 | Reichental et al. | 83/488 |
| 5,431,077 | 7/1995 | Murakami | 83/487 |

*Primary Examiner*—Marina T. Rachuba
*Attorney, Agent, or Firm*—Dority & Manning, P.A.

[57] ABSTRACT

An apparatus and method are provided for converting a roll of material into various products such as curtains, draperies, valances, or the like. Specifically, the apparatus includes a roll let off for supporting and feeding a roll of material or cloth. After the let off, the edges of the cloth are cut if desired and are engaged by a pair of edge folding and positioning stations for forming vertically folded edges. The folded edges are then converted into hems and sewn into the material by a pair of corresponding hem sewing heads and cloth advancers. Once vertical hems are formed in the cloth, the cloth is cut to predetermined lengths and if desired, folded in a predetermined pattern. The folded pattern can then be transported to a sewing station for further sewing the material into a desired product.

21 Claims, 24 Drawing Sheets

FOLDING AND SEWING APPARATUS

This is a continuation of application Ser. No. 08/250,797, filed May 27, 1994, now U.S. Pat. No. 5,572,940.

BACKGROUND OF THE INVENTION

This invention relates to a method and apparatus for producing finished sewn products from a roll of cloth. More particularly, the method and apparatus pertains to cutting predetermined lengths of fabric from a large roll of fabric and then performing various sewing operations on the fabric to produce articles such as lined drapes, sheets, valances, etc.

Heretofore, one of the major expenses in producing valances was cutting lengths of fabric to precise lengths and then sewing folded hems on the edge of the fabric prior to performing additional sewing operations. Such has been time consuming and labor intensive adding considerable cost to the finished products.

OBJECTS AND SUMMARY OF THE INVENTION

It is a principal object of the present invention to provide a method and apparatus for efficiently cutting fabric into predetermined lengths and automatically performing sewing operations thereon.

Another important object of the present invention is to provide a method and apparatus for automatically cutting fabric from a large roll and then automatically folding the edges of the fabric. The folded edges are then sewn into hems, and the fabric is transported to a folding station. After the fabric has been folded at the folding station, it is then transported to another sewing station for performing sewing operations thereon.

Still another important object of the present invention is to provide an efficient and automatic system for folding and sewing sheet material.

Still another important object of the present invention is to provide an efficient method and apparatus for automatically producing sewn valances from a roll of cloth.

Still another important object of the present invention is to provide an apparatus and method for automatically producing hemmed fabric for subsequent manufacture into drapes and the like.

Still another important object of the present invention is to provide a method and apparatus for cutting fabric in predetermined lengths, folding the edges of the fabric to produce precise hems and then transporting said fabric to a receiver.

A further object of the present invention is to provide a method and apparatus for precisely folding fabric of a predetermined length into a desired folded pattern for subsequent sewing.

Still another important object of the invention is to provide a method and apparatus for automatically sewing sockets and pockets into a folded fabric to produce valances.

Additional objects of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus of the present invention comprises a let off device which carries a large roll of fabric that is to be used for producing the finished product. The fabric is unwound by the let off device which is under the control of a dancer so as to maintain uniform tension in the fabric as it leaves the let off device. The open fabric then passes under a pair of spaced edge cutters which trim opposed edges of the fabric to a predetermined width.

After the fabric has been trimmed, the edges of the fabric are folded in by a hem forming and hem width control device. The folded edge of the fabric is maintained at a precise location by means of a photoelectric sensor and a hem shifting device. The photoelectric sensor includes a pair of laterally spaced photosensors which generate signals indicating when the edge of the fabric is at the precise location in between the two photodetectors. The photodetectors in turn control the hem shifting device to keep the edge of the hem properly aligned. After the hem has been folded onto the edges of the open cloth, the hem then passes through a curling device which curls the outer edge of the hem under so as to produce a double layer hem. This curl portion is then passed under a sewing head which advances the cloth and sews the hem into the edges of the fabric. The fabric is then fed into an accumulator which accumulates a predetermined length of fabric.

Following the accumulator is a length cutter which makes a transverse cut across the fabric to cut the fabric into predetermined lengths.

In order to cut the fabric into predetermined lengths, a cloth puller moves from the downstream end of the machine to adjacent the cutting head for gripping the edge of the fabric in order to pull the fabric from the accumulator when the cloth puller is moved back towards the downstream end of the machine. After the cloth puller pulls the cloth back towards the end of the machine, a predetermined length of cloth rests on a folding table and is ready for being folded into a desired pattern. In one particular embodiment, the apparatus is used for making valances. At the folding table it is desired to fold the open fabric so that it can be subsequently sewed with elongated stitching to produce the final product.

In order to fold the open length of fabric on the folding table, a pair of spaced dies are lowered down on top of the fabric. The dies are spaced a distance that corresponds to the ultimate width of the valance.

Once the dies are lowered onto the fabric carried on the folding table, the cloth puller which is still gripping the leading edge of the fabric is moved back towards the front end of the machine, folding the fabric over a first die. It then releases the leading edge of the cloth and moves back adjacent the end of the machine. The trailing edge of the cut cloth is then folded up over the second die and overlaps the edge of the cloth that was previously folded.

The cloth in this folded position is then transported to a sewing station wherein two sewing heads are provided for sewing a pair of elongated spaced stitching so as to form a socket in the folded fabric for receiving a curtain rod as well as a pocket in the fabric. This completes the construction of the valance.

The apparatus and machine can also be used for producing lined draperies. When being used to produce lined draperies, a second roll of fabric is carried on a second let off above the first let off which carries the facing layer of fabric. The fabrics are superimposed on each other under uniform tension. The superimposed liner and facing are then passed through the cutting and hem forming device as described above. The cloth puller is used for pulling the sewn liner and facing from an accumulator so that they can be cut to a desired length.

The folding operation discussed above takes place in a similar but wider spaced configuration when producing lined draperies.

The accompanying drawings, which are incorporated in and constitute a part of this specification, illustrate the embodiments of the invention and together with the description, serve to explain the principle of the invention.

It is to be understood that the invention is made up of a plurality of various elements. It is understood of course that equivalent components could be substituted for the elements shown in the drawings and described hereto in the specification without departing from the spirit or scope of the present invention.

Figure 1:
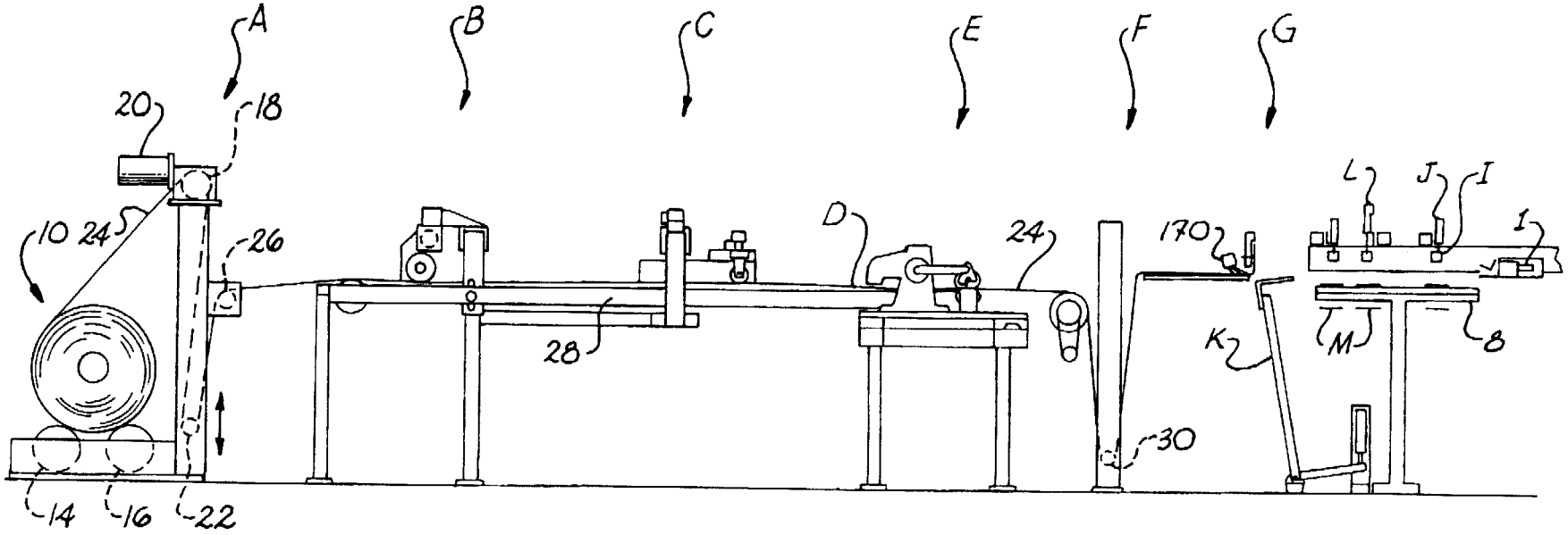
FIG. 1 is a side elevational view illustrating a portion of a machine constructed in accordance with the present invention.

Repeat use of reference characters in the present specification and drawings is intended to represent same or analogous features or elements of the invention.

DESCRIPTION OF THE PREFERRED EMBODIMENTS

Referring in more detail to the drawings, FIG. 1 is a side elevational view of the machine which is provided for hemming and cutting predetermined lengths of material from a large roll of material 10. The large roll of material 10 is carried on a let off A. The let off A includes a pair of idle rollers 14 and 16 which permit the roll 10 of cloth to be rotated when it is pulled by a power driven roll 18 which has a friction covering thereon. The power driven roll 18 is driven by an electric motor 20. The motor is a variable speed driven motor which is under control of a dancer roll 22. The dancer roll 22 is permitted to move up and down responsive to variations in tension in the cloth extending therearound. As the dancer roll 22 moves up and down, it varies the adjustment on a potentiometer that in turn varies the voltage applied to the motor drive board for varying the let off speed for the cloth. The cloth 24 is then fed from the let off A up over a guide roll 26 onto a sewing table 28. As the cloth enters the sewing table, it first passes through an edge cutting device B. There are two edge cutters B spaced on opposite sides of the table so as to cut the cloth to a predetermined width. The cloth then moves under an edge folding and positioning station C which forms a fold of a predetermined width in the edge of the cloth. This occurs on one or both sides of the cloth.

From the edge folding and positioning station C, the cloth is then fed to a hem folding mechanism D which folds the hem into a double fold. From the hem folder D, the cloth is then fed under to a hem sewing head and cloth advancer E for sewing the hem into the edge of the cloth.

The cloth is fed from the hem sewing head and cloth advancer E into an accumulator F which accumulates a cloth reserve. The cloth passes around an adjustable tension roll 30 provided in the accumulator and from the roll 30 proceeds up onto a cutting table.

Provided on the cutting table is a length cutter G which cuts the cloth from one side to the other.

The particular length of cloth that is cut at this point is controlled by a cloth puller H. To explain the operation to this point we will take up from the point where the cloth was previously cut. As a result, there is a leading edge of cloth 24 directly under where the transverse cutter blade severed the cloth.

The cloth puller H is brought up from the end of the machine into engagement with the leading edge of the cloth 24 directly under the path of the cutting blade. The cloth puller H then grips the edge of the cloth and pulls it back towards the end of the machine over a folding table 8. The cloth puller H pulls the cloth a predetermined length. Once the cloth 24 reaches that predetermined length, the cloth puller H is stopped by a proximity switch. The length cutter G then cuts the cloth extending over the table to a predetermined length.

While the cloth is on the folding table, folding dies I are lowered down on top of the cloth. Die lifters J are used for lowering the dies I down onto the cloth and retracting. Later they cycle to raise them up off of the cloth. Once the dies I are put in position on top of the cloth, the cloth puller H is moved back towards the cut edge to fold the leading edge of the cloth over the first folding die. It releases the cloth and retracts back to the end of the machine.

A trailing end folder K is then used for folding the trailing end of the cloth over the other die and other edge of the cloth. Once the cloth is folded, and in this particular instance for making a valance, a cloth hold down bar L is lowered on top of the free edges of the cloth pressing them in contact with a cloth shifter M. The cloth shifter M includes a plurality of drive belts which are supported on the folding table 8 directly beneath the bottom surface of the folded cloth and are in engagement therewith. In particular, the two dies and the cloth hold down bar L press the cloth down into engagement with the cloth shifting belts M.

The folded pattern is then shifted laterally off of the folding table.

As the folded pattern is shifted laterally off of the folding table, the leading edge comes in contact with an edge separating device N (see FIG. 26) which separates the upper edge from the lower edge and feeds it into a hem edge curler O which curls the upper edge inward to form a hem. The curled upper edge then is shifted by the cloth shifter M into engagement with the sewing head of a first sewing machine P. The first sewing machine sews the hem into the folded pattern to produce a pocket in the folded fabric. A second sewing head Q follows the first sewing head P and puts a continuous stitch in the fabric which is laterally spaced from the stitch placed by the first sewing head P so as to sew an elongated socket in the valance which is capable of receiving a curtain rod.

A photocell R is carried by the first sewing head P to sense the leading edge of the folded pattern as it is shifted by the cloth shifter M. At this point in the operation, both of the sewing heads P and Q are operating at the same speed so as to place the same number of stitches per inch in the fabric. However, upon the photosensor R sensing the leading edge of the folded pattern, it causes a signal to be generated that in turn slows down the rate that the cloth shifter is moving the cloth over the table and also slows down the stitching speed of the second sewing machine Q. As a result, the first sewing machine P goes into a tack mode to place more stitches per inch at the leading edge of the folded fabric. The tack mode continues for approximately one inch and then a controller associated with the operation of the sewing station returns the cloth edge shifter M to its original traveling speed and returns the speed of the second sewing head Q to its original speed. At this point in time, the folded fabric continues to be moved under both of the sewing heads P and Q to place a less dense stitch in the main body of the valance. Upon reaching the trailing edge of the folded pattern, the tack mode is again entered into to place more stitches per inch adjacent the trailing edge of the valance. All of this is under control of a controller that is activated by the photocell R. Any suitable controller can be used for synchronizing the operation of the feed of the fabric with the speed of the cloth shifter M and the sewing machine Q.

Figure 27:
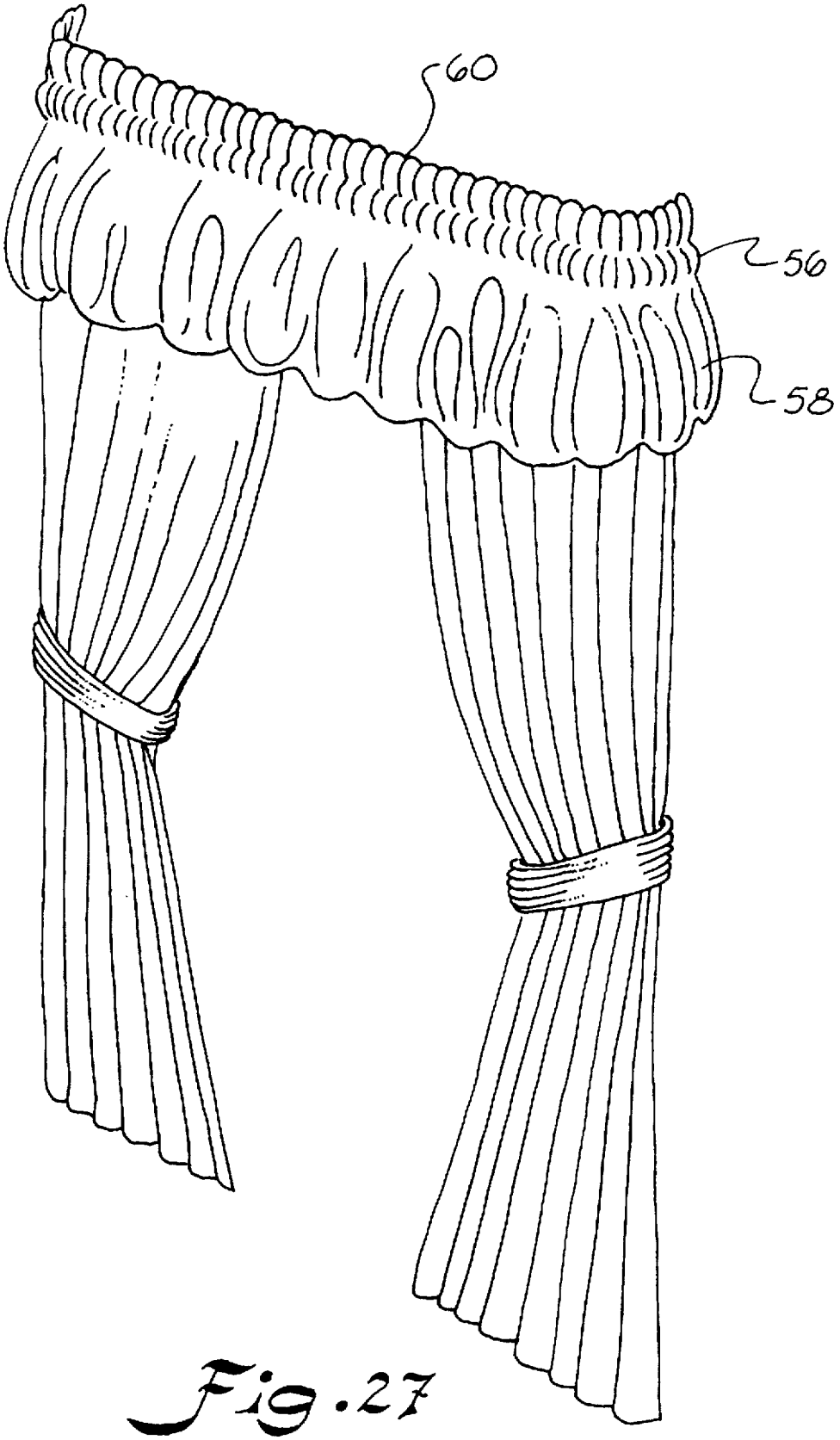
FIG. 27 is a perspective view illustrating a valance that was sewn automatically on the apparatus of the present invention.
Figure 28:
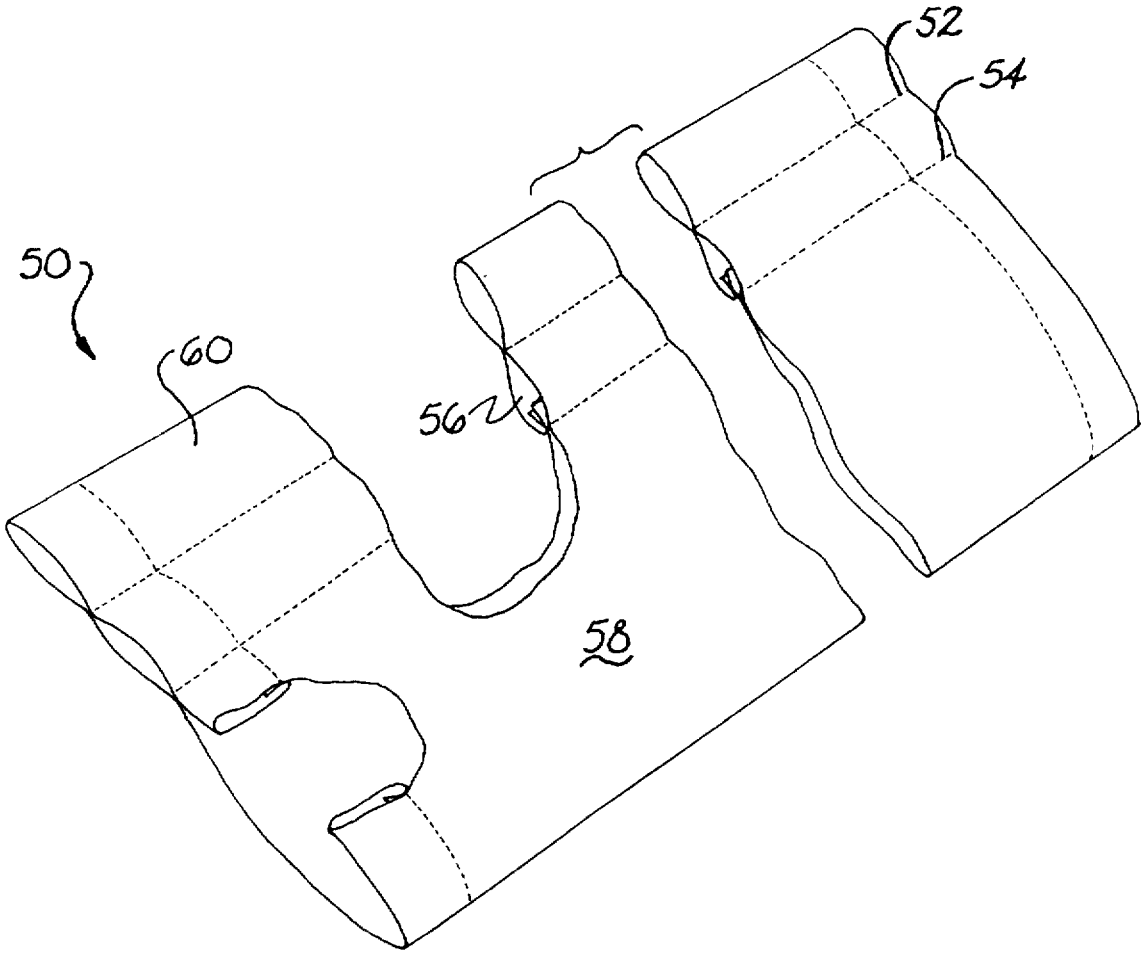
FIG. 28 is a perspective view with parts broken away for the purpose of clarity illustrating a sewn valance.

Before describing in detail the operation of the cloth cutting and sewing apparatus, one's attention is directed to a valance such as shown in FIGS. 27 and 28 that can be produced automatically on the apparatus. As can be seen, the valance 50 is produced from a predetermined length of fabric that is folded over and has a hem 52 sewed along its length. Another seam 54 is sewn longitudinally the length of the valance. As a result, a socket 56 is produced in the valance for receiving the conventional curtain rod holder and a pocket 58 is provided in the valance which can be stuffed with any suitable material to bulk up the valance if desired.

As shown in FIG. 27, when the valance is mounted over a window it has a header portion 60 located directly above the socket 56 through which the curtain rod extends. The valance can be gathered together to any degree to make the final position and design of the valance aesthetically pleasing.

Referring now to FIG. 1, the let off A may be any suitable conventional let off that allows the cloth to be unrolled from a large roll of cloth such as 10 and supplied under a uniform tension to a working table.

Figure 2:
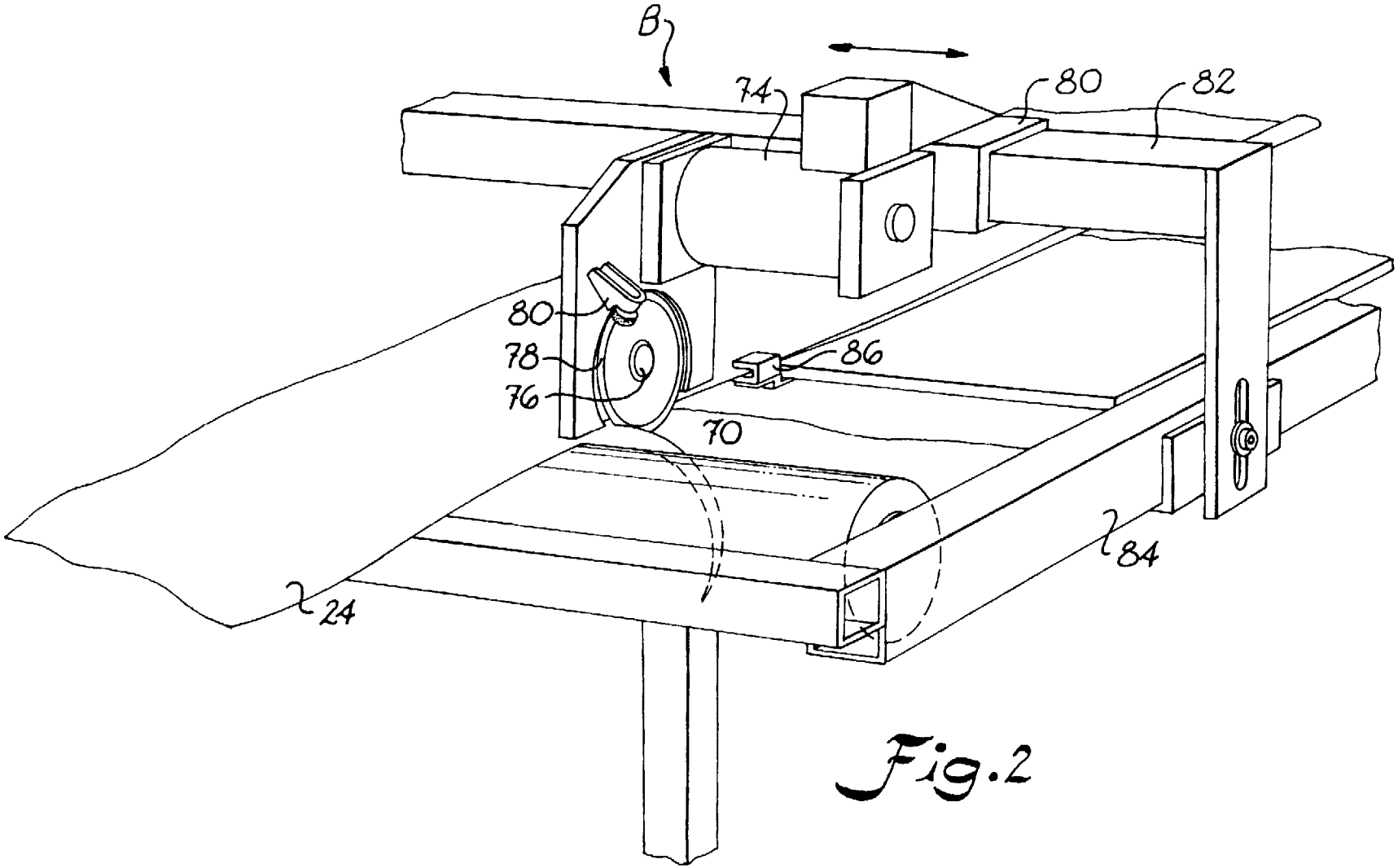
FIG. 2 is an enlarged perspective view illustrating a cutting head used for cutting the edge of a fabric.

One particular cutter B that can be used for cutting an edge 70 off of the cloth is shown in FIG. 2. It includes a motor 74 which can be energized by any suitable source of power that is in direct engagement with a shaft 76 which carries a rotating cutting disc 78. As the cloth 24 moves under the disc 78, it severs the cloth. In order to make the cut produced by the rotating disc cleaner, a carbide block can be placed closely adjacent the lower edge of the blade so that the cloth is severed by the outer edge of the blade pressing against the carbide block. An edge sharpener 80 can be carried adjacent to the cutting edge of the blade for being brought into engagement when desired to sharpen the blade 78. The blade assembly and motor 74 is mounted on a carriage 80 which can be shifted laterally on a cross-support bar 82 that is in turn supported on the frame 84 of the table. As a result, the width of the cloth can be adjusted by moving the cutting head B laterally onto the cross bar 82.

As the edge of the cloth 24 is severed by the cutting blade 78, it then passes between a channel shaped member 86 which maintains the edge of the cloth straight during the severing operation by the blade.

After the cloth passes through the channel shaped member 86, it is fed to the edge folding and positioning station C. The edge folding and positioning station C is shown in greater detail in FIGS. 3 and 4. The purpose of the edge folding and positioning station C is to properly and uniformly fold both edges of the fabric so that a straight and uniform width hem can be subsequently sewed into the edges of the cloth. The location of the inner edge 90 of the cloth is sensed by a pair of photoelectric sensors 92 and 94. As long as the edge of the folded cloth is positioned in between the sensors 92 and 94, no signal is generated to rotate an adjusting wheel 96. As a result, a uniform width fold is produced in the edge of the cloth for subsequently hemming.

If the width of the fold is too great, then both of the photosensors 92 and 94 will be activated. When such occurs, a signal is generated and fed to an electric motor or any other suitable type motor 98 through conventional control circuitry. When the motor 98 is in turn activated, it rotates the wheel 96 clockwise. This clockwise motion of the wheel 96 causes the edge 90 of the cloth 24 to move outwardly. After a short delay, photosensors 92 and 94 are again activated for sensing the edge 90 of the cloth 24. If the cloth is not properly aligned at this point, the wheel 96 is rotated further. If inner edge 90 is properly aligned between sensors 92 and 94, no further adjustments are needed, and wheel 96 assumes a straight path.

If on the other hand the folded edge 90 is not wide enough and does not come between under each of the photosensors 92 and 94, then the wheel 96 is rotated in the counterclockwise direction similar to as described above to guide the edge 90 of the fabric back between the photosensor cells.

The photosensor cells 92 and 94 include a light source positioned under the fabric and a sensor positioned on a space member. The fabric moves between the light source and the two sensor heads and operates in the conventional manner.

Figure 4:
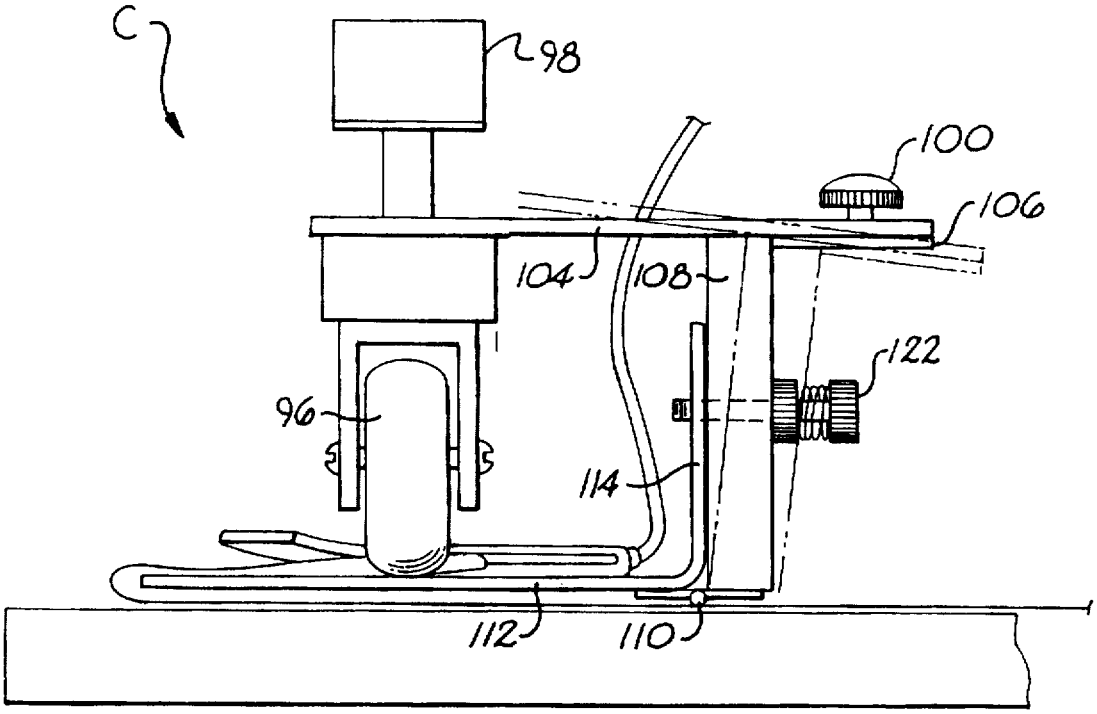
FIG. 4 is an end view of the edge aligning and locating device.
Figure 5:
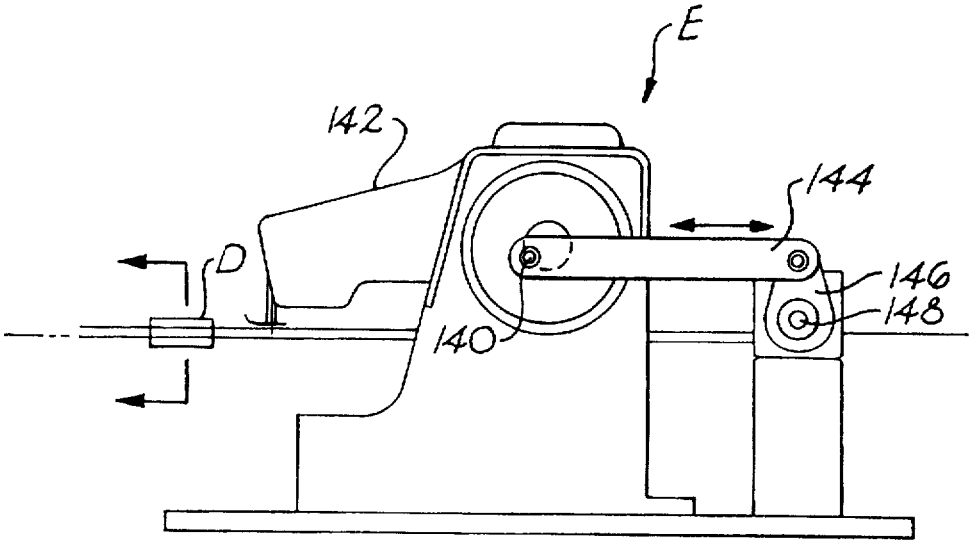
FIG. 5 is an elevational view illustrating one of the sewing machines used for sewing the hem on one side of the fabric.

The position of the wheel 96 can be physically adjusted by loosening a screw 100 that is carried within an elongated slot 102 provided in a bracket 104. The screw extends into a horizontal supporting plate 106 which is in turn carried on top of support block 108. As can be seen in FIG. 4, the support block 108 is in turn hinged adjacent its lower end through a hinge 110 to a fold forming plate 112.

Figure 3:
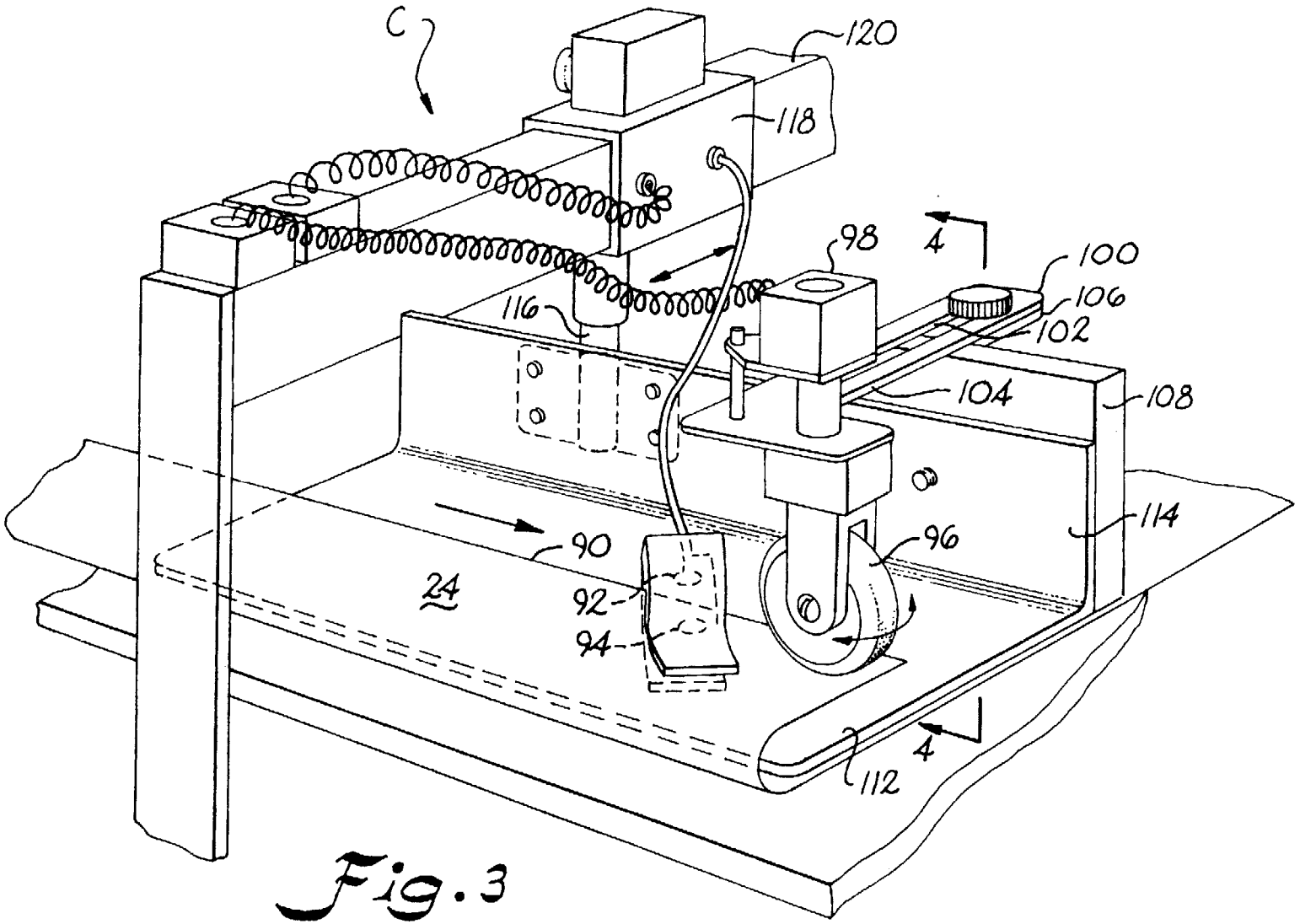
FIG. 3 is an enlarged perspective view illustrating an edge folding and positioning device.

The fold forming plate 112 has a vertically extending flange 114 that is in turn fixed to a vertical shaft 116 as shown in FIG. 3 that is in turn carried on a slidable tubular member 118. The slidable tubular member 118 is carried on a square horizontally extending tubular member 120. As a result, the horizontal or lateral position of the entire edge folding and positioning station C can be adjusted.

A spring loaded screw 122 extends between the support block 108 and the vertical flange member 114 for applying a predetermined pressure through the wheel to the cloth during its guiding operation. As can be seen in FIG. 4, the entire wheel assembly including the wheel 96 and the motor 98 can be pivoted slightly about the hinge 110 for controlling the pressure asserted on the cloth during the guiding operation.

Figure 6:
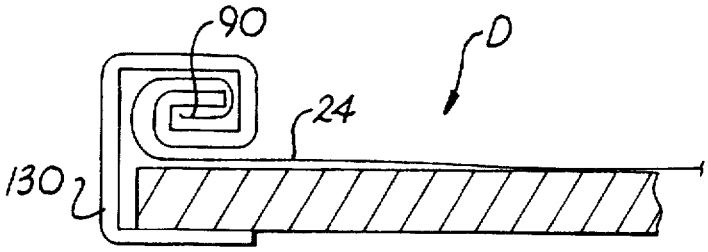
FIG. 6 is a sectional view illustrating the curl and double folded hem produced on the edge of the fabric.
Figure 7:
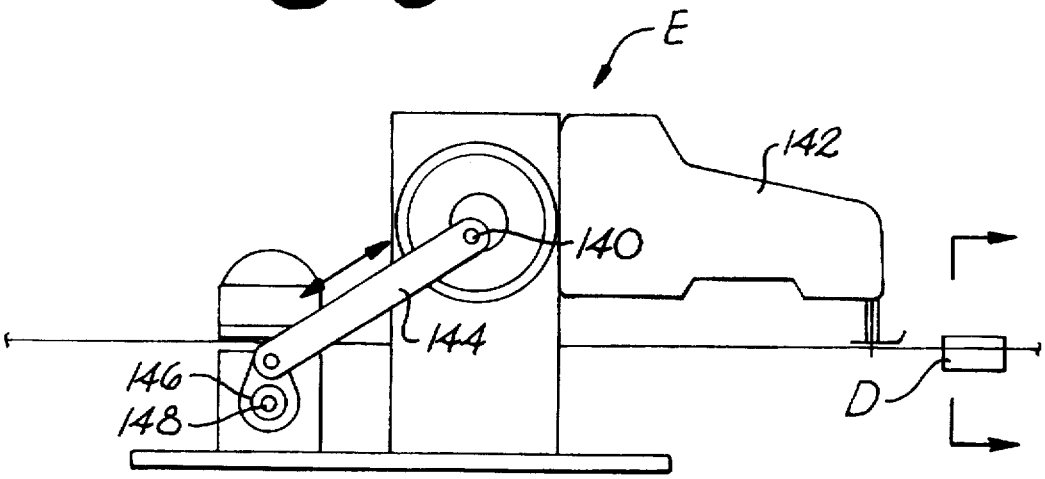
FIG. 7 is an elevational view illustrating a sewing head positioned on the opposite side of the fabric from the sewing head of FIG. 5.

After the cloth passes under the edge folding and positioning station C, it then moves through a conventional hem edge curler D such as shown in cross-section in FIG. 6. The hem edge curler D includes a spherically twisted piece of sheet metal 130 that curls the cloth 24 into a double fold adjacent its leading edge 90 such as best shown in FIG. 6. Such is a conventional hem forming mechanism. Once the fold is placed in the edge of the cloth 24, it then passes under a hem sewing head and cloth advancer E as shown in FIGS. 5, 7, 8, and 9. At this point on the table, the cloth has been advanced or moved forward by the cloth advancer E.

The hem sewing head 142 is a conventional sewing head that sews the hem into the edge of the cloth once it is folded by the folder D.

Coupled to the shaft 140 of the sewing head 142 is an eccentrically mounted linkage 144. This linkage in turn is connected off center to a shorter linkage 146 that is in turn carried on a shaft 148.

During the sewing operation, the upper shaft 140 of the sewing machine runs continuously. As a result of the linkage 144 being eccentrically attached to the shaft, a reciprocating motion is imparted to the linkage member 144. Such is shown by the arrow 150 in FIG. 8. This reciprocating motion is in turn imparted to the shaft 148 which has a sprague clutch mounted therein which permits rotation to take place in one direction. The output of the sprague clutch is connected to an advancing roll 152 that engages the surface of the cloth 24 for pulling the cloth through the sewing head and across the table described previously.

The purpose of intermittently pulling the cloth through the sewing head is for not pulling the cloth when the needle is in the cloth. In other words, the material is only pulled when the needle comes out of the cloth. Thus, the feed roll 152 advances the cloth a predetermined distance in synchronicity with the sewing machine. A second roller 154 is positioned in tandem with the drive roller 152 and is in pressure engagement therewith so that when the drive roll 152 is rotated it causes the cloth 24 to be advanced therebetween.

Figure 8:
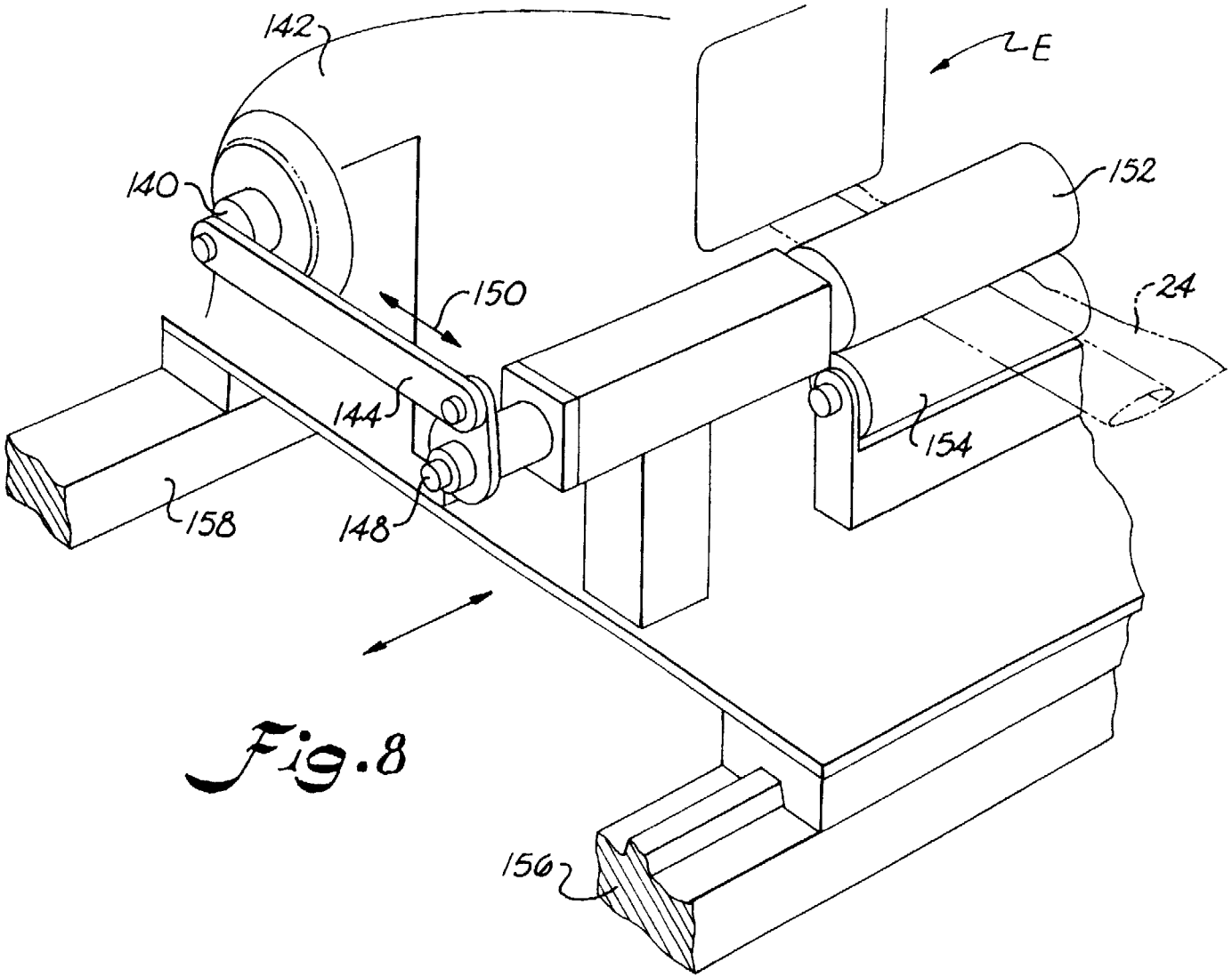
FIG. 8 is an enlarged perspective view illustrating one of the sewing heads used for sewing the hems into the fabric.

As shown in FIG. 8, the sewing head E is carried on laterally extending guide rails 156 and 158 so that its position can be adjusted for accommodating and sewing cloth of various widths.

As a result of using a sprague clutch to the output of shaft 148 instead of a ratchet, the clutch will give infinitesimal adjustable intermittent forward movement through the cloth as compared to a ratchet which would be controlled by the spacing between the individual teeth. The principle of moving in one direction is analogous to a ratchet operation but by operating through a sprague clutch one can adjust the forward stroke.

Figure 9:
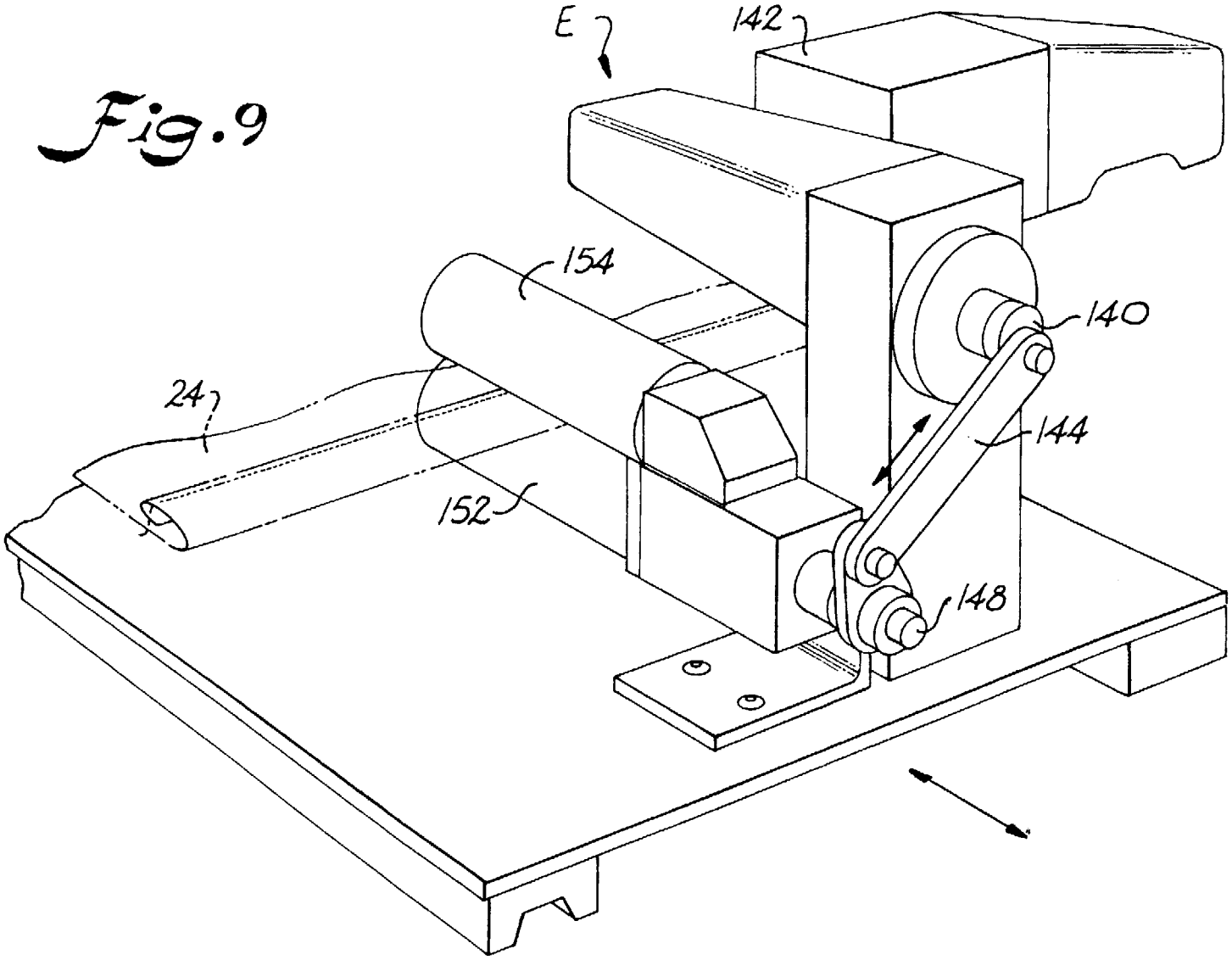
FIG. 9 is a perspective view illustrating another embodiment of the sewing head of FIG. 8.

In FIGS. 8 and 9, two embodiments of a sewing head and cloth advancer E are shown. In particular, in FIG. 8 the drive roller 152 is located above second roller 154. In FIG. 9, on the other hand, drive roller 152 is located below the second roller 154. Either embodiment can be used in the apparatus of the present invention. However, for most conventional sewing heads such as 142, preferably the drive roller is located below the static roller for smoother operations. Of course, depending upon the equipment used or the particular circumstances, drive roller 152 can be placed in either position.

After the cloth 24 passes under the hem sewing head and cloth advancer E it is then fed into the accumulator F as shown in FIG. 1. The weight of the roll 30 pulls the cloth down into the accumulator to accumulate a reserve of cloth.

The cloth extends around the bottom surface of the roll 30 and up on top of the length cutting table where a length cutter G has previously severed the cloth. At the cutting table, the cloth is being held in place by means of a brush like member 170. The brush like member 170 extends entirely all the way across the frame. The angles of its bristles 172 point in the forward direction, in the direction of the cloth, so that the cloth can pass easily thereunder. However, brush member 170 prevents the cloth from being pulled backwards into the accumulator once the edge of the cloth has been severed by the length cutter G.

Figure 10:
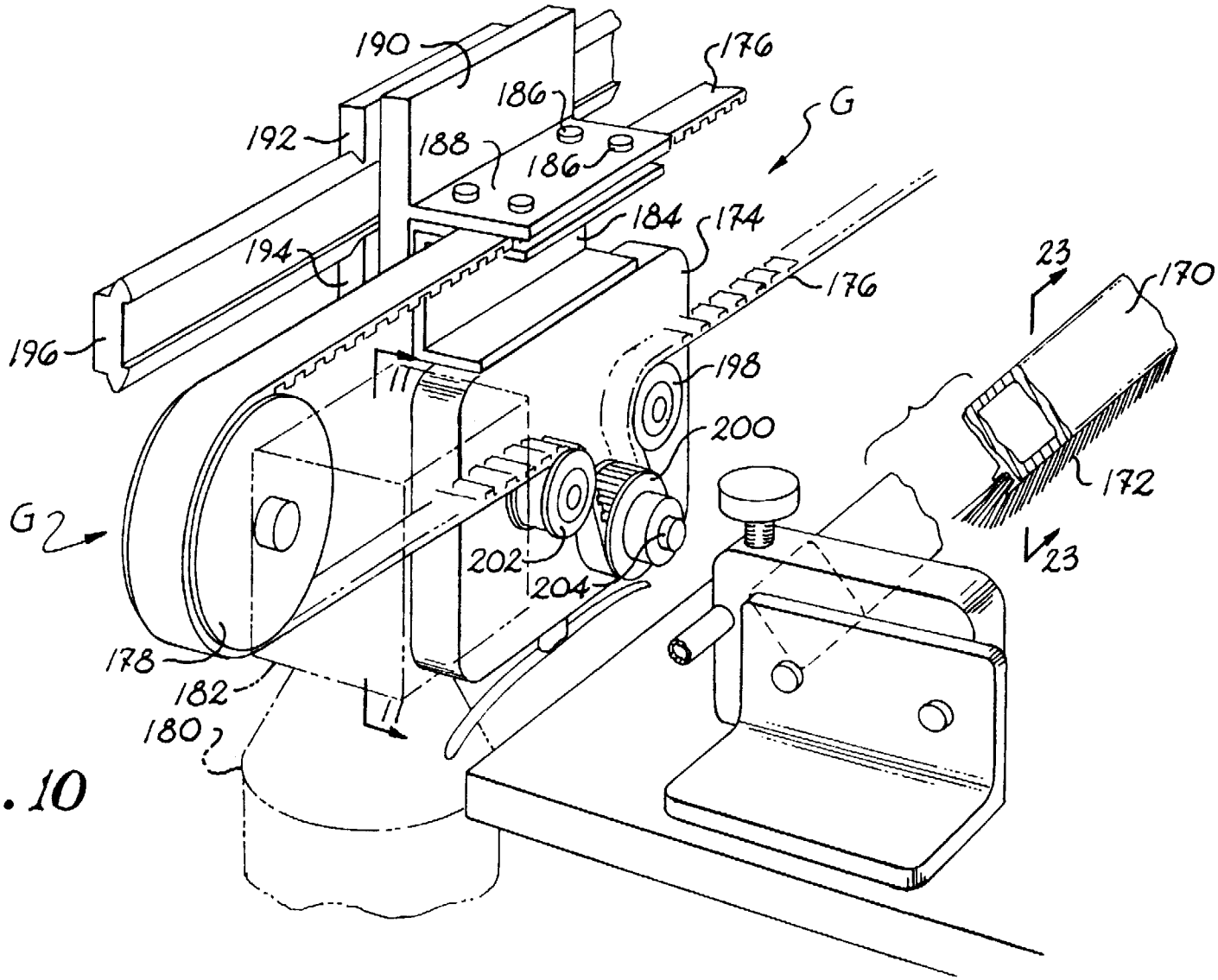
FIG. 10 is a perspective view of a movable cutter which is used for cutting the cloth into predetermined lengths.
Figure 23:
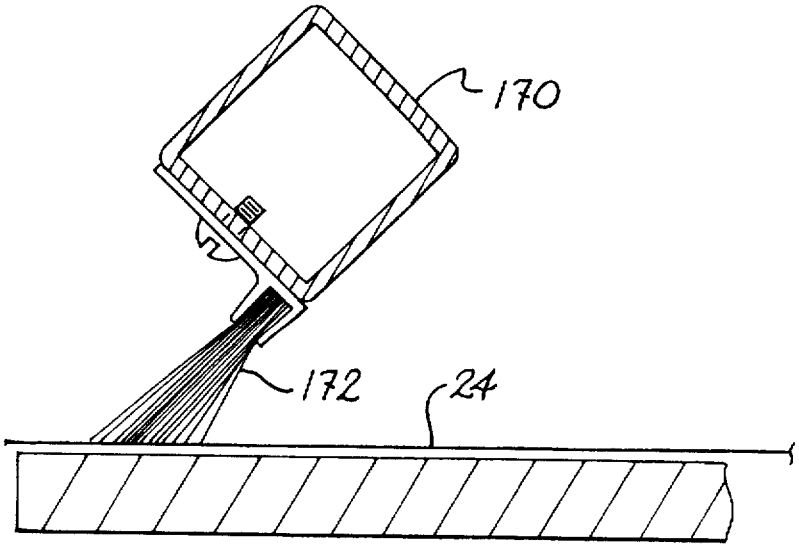
FIG. 23 is a cross-sectional view illustrating a gripping device for gripping and retaining the cloth prior to the cloth being cut into predetermined lengths.
Figure 11:
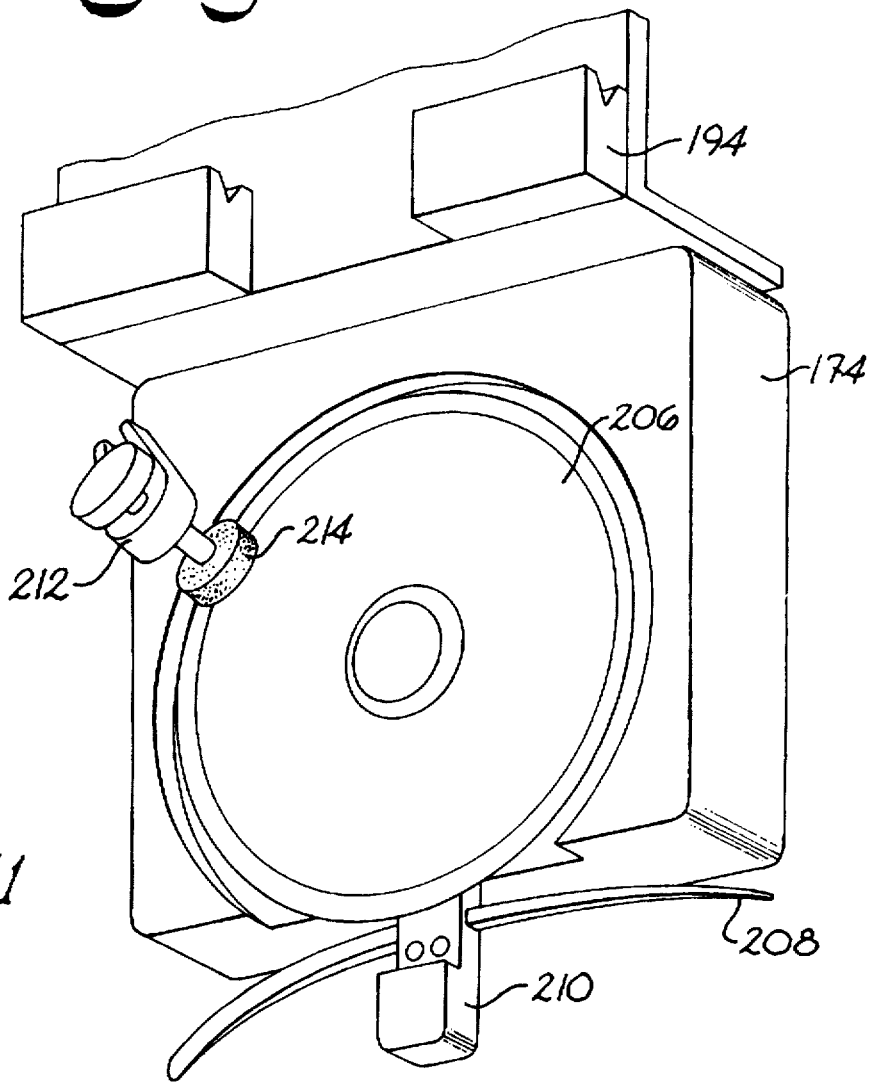
FIG. 11 is an enlarged perspective view illustrating the cutter head from part of the cutter of FIG. 10.

The length cutter G is shown in greater detail in FIGS. 10 and 11. It includes a cutting head 174 that is propelled back and forth across the cutting table by a gear tooth belt 176 that is driven by a driven pulley 178. The pulley 178 is driven by a conventional electric motor 180 through a gear box 182 which is shown in broken lines in FIG. 10 so as not to obscure the remaining parts of the drawing. The cutting head is carried on a channel shaped bracket 184 that is in turn attached to the gear tooth belt 176 by means of bolts 186 which extend through a plate 188. The channel member 184 is in turn attached to a supporting block 190 that has a pair of spaced guide channels 192 and 194 attached thereto. The pair of spaced guide channels are in turn supported on a rail 196. The guide channels 192 and 194 are made of a self-lubricating material such as high molecular weight polyethylene so that the cutting head can be readily reciprocated back and forth across the machine during the cutting operation.

The timing belt 176 extends around a roller 198 which guides the belt around a geared roller 200 for driving the gear roller 200. The belt then extends up around another idle roller 202. As a result, as the belt is driven by the drive roller 178, the cutting head moves back and forth across the cutting table. As it moves back and forth across the cutting table, the gear roller 200 is rotated. The gear roller 200 is fixed to a shaft 204. The other end of the shaft 204 has a circular cutting blade 206 secured thereto.

A leaf spring 208 is carried adjacent to the lower end of the cutting head and the blade 206 so that it passes under the cloth during the cutting operation and guides the cloth into engagement with the rotating edge of the blade 206. A carbide cutting block 210 is positioned adjacent to the bottom edge of the cutting blade 206 so as to make a clean severance of the cloth as the cutting head traverses back and forth across the machine.

The cutting head has a sharpening device 212 mounted thereon so that when a sharpening head 214 is brought into engagement with the rotating blade, it sharpens the edge of the blade at a proper angle.

The guide rail 196 upon which the length cutter G is carried extends entirely across the cutting table and is supported by its ends by any suitable standards.

As shown in FIG. 1, the cloth puller and leading edge folder device H is provided for pulling a predetermined length of cloth from the accumulator across a folding table 8 so that the length of the cloth can be cut by the length cutter G. The cloth puller has a gripping jaw that can be closed over the edge of the cloth that was cut by the length cutter. Once the cloth puller H engages the edge of the cloth, it can be retracted for pulling a predetermined length of cloth from the accumulator F.

Figure 12:
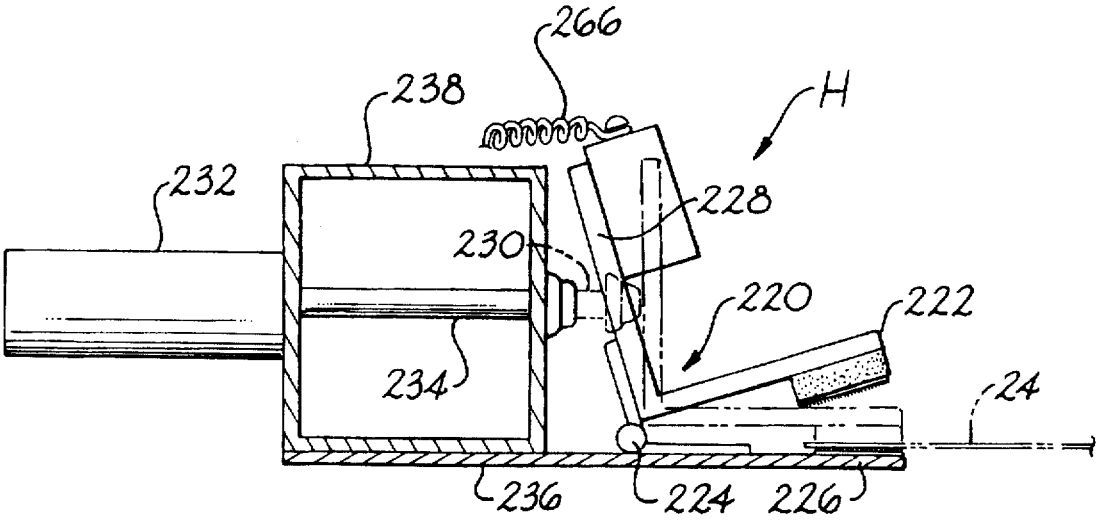
FIG. 12 is a cross-sectional view of a movable gripping head carried on the cloth puller shown in more detail in FIG. 21.
Figure 21:
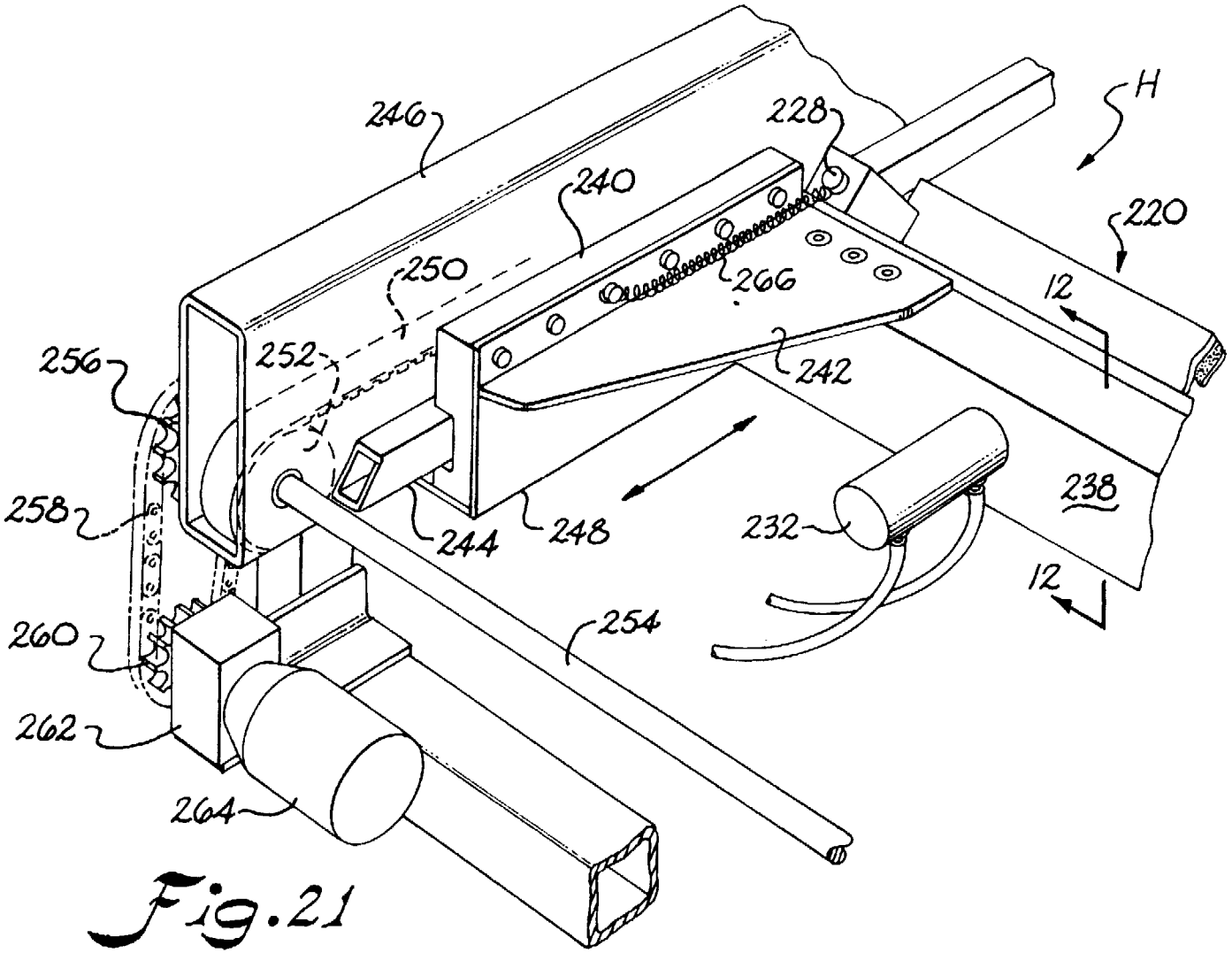
FIG. 21 is an enlarged fragmentary perspective view illustrating a portion of the cloth pulling device.

The cloth puller H as shown in FIGS. 12 and 21 includes a pivoting gripping jaw 220 that has an upper movable flange member 222 that is hinged at hinge joint 224 that can be pivoted downwardly to a closed position to grip the leading edge of the cloth 24 with a cooperating jaw 226 located therebelow. The gripping jaw has a vertically extending flange 228 connected thereto so that when the flange is pushed forward by a plunger 230 to a vertical position, the gripping jaw 220 will be pushed down to grip the cloth. The plunger 230 is carried on the output of a pneumatically operated cylinder 232 that has a piston 234 extending therefrom. The hinge member 224 is supported on a base plate 236 that is in turn secured to a tubular member 238. The tubular member 238 is in turn supported on spaced slide blocks 240 constructed of lubricated high molecular weight polyethylene material. Angle members 242 secure the tubular member 238 to the side block 240. Side blocks 240 are carried on opposite sides of the frame as only one side of the cloth puller H is shown in FIG. 21. The slide blocks 240 are in turn carried on a tubular rail 244 that is suitably supported on side frame members 246. The guide blocks 240 have a metal support plate 248 attached to the bottom thereof which are in turn attached to a timing belt 250. The timing belt 250 extends around spaced driven pulleys 252. One of the pulleys 252 is supported on a rotatable shaft 254. The upper end of rotatable shaft 254 has a gear 256 provided thereon. The gear 256 is in turn coupled by a chain 258 to a grip driven gear 260. The driven gear 260 is coupled to the output of a gear box 262 which has its input connected to a motor 264. By turning the motor 264 on and off, the gripping jaw 220 can be moved along the guide rail 244 to a position closely adjacent the previously cut end of the cloth for gripping the cloth. Once the gripping jaw 220 is engaged to grip the cloth, it can be retracted to pull a predetermined length of cloth from the accumulator.

A spring 266 extends from a vertically extending portion 228 of the jaw and the slide block 240 to hold the jaws in a normally open position. In order to close the jaw 220, air is supplied to the pneumatic cylinder 232 to move the piston to the right, as shown in FIG. 12. When the piston 234 is moved to the right, the plunger 230 engages the vertically extending portion of the upper jaw to pivot it about the hinge 224 to cause the horizontal gripping jaw 222 to move to the closed position where it would engage the cloth.

Figure 13:
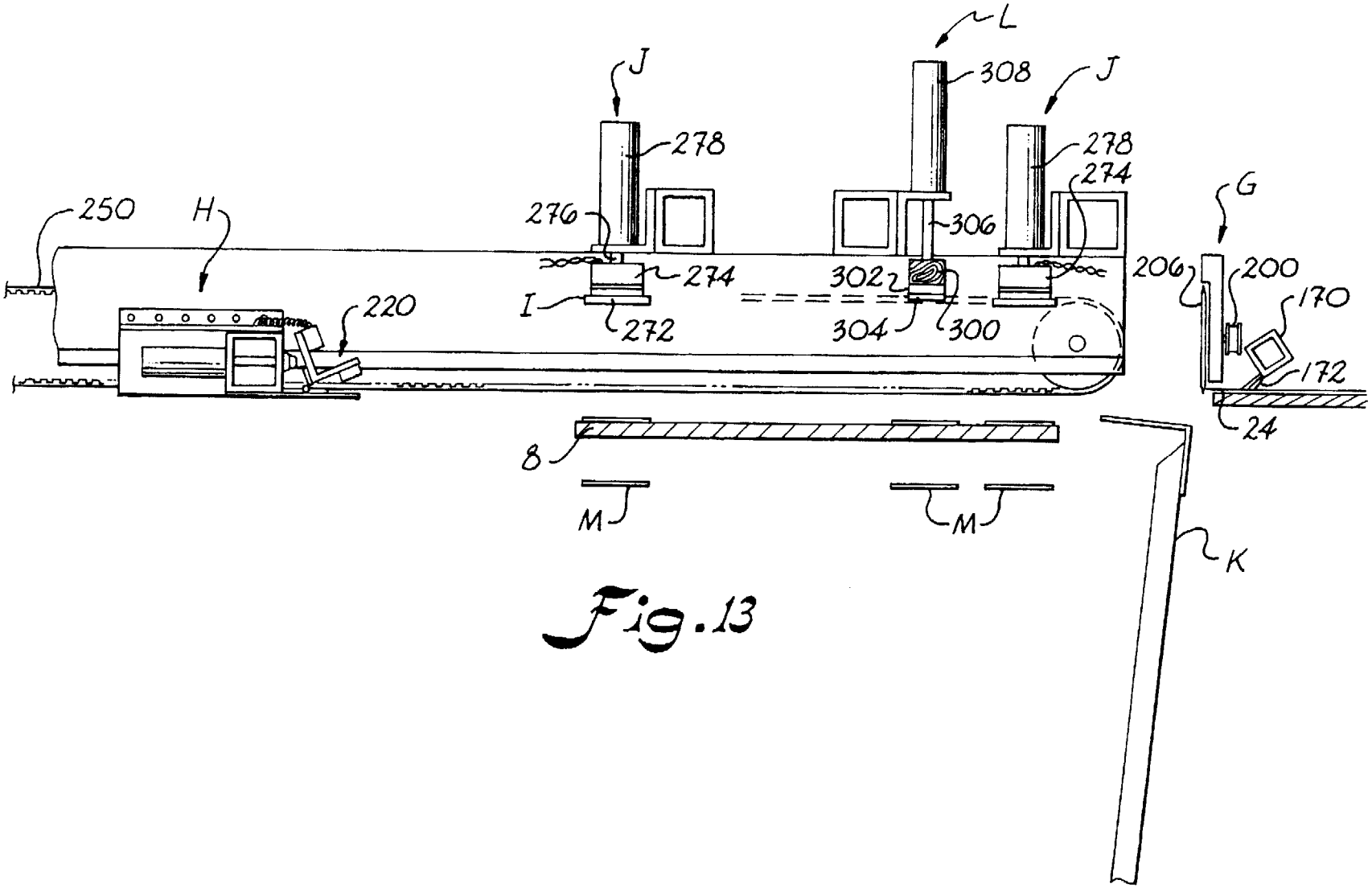
FIG. 13 is an end view partially in section illustrating a portion of the folding table and the cloth pulling mechanism.
Figure 22:
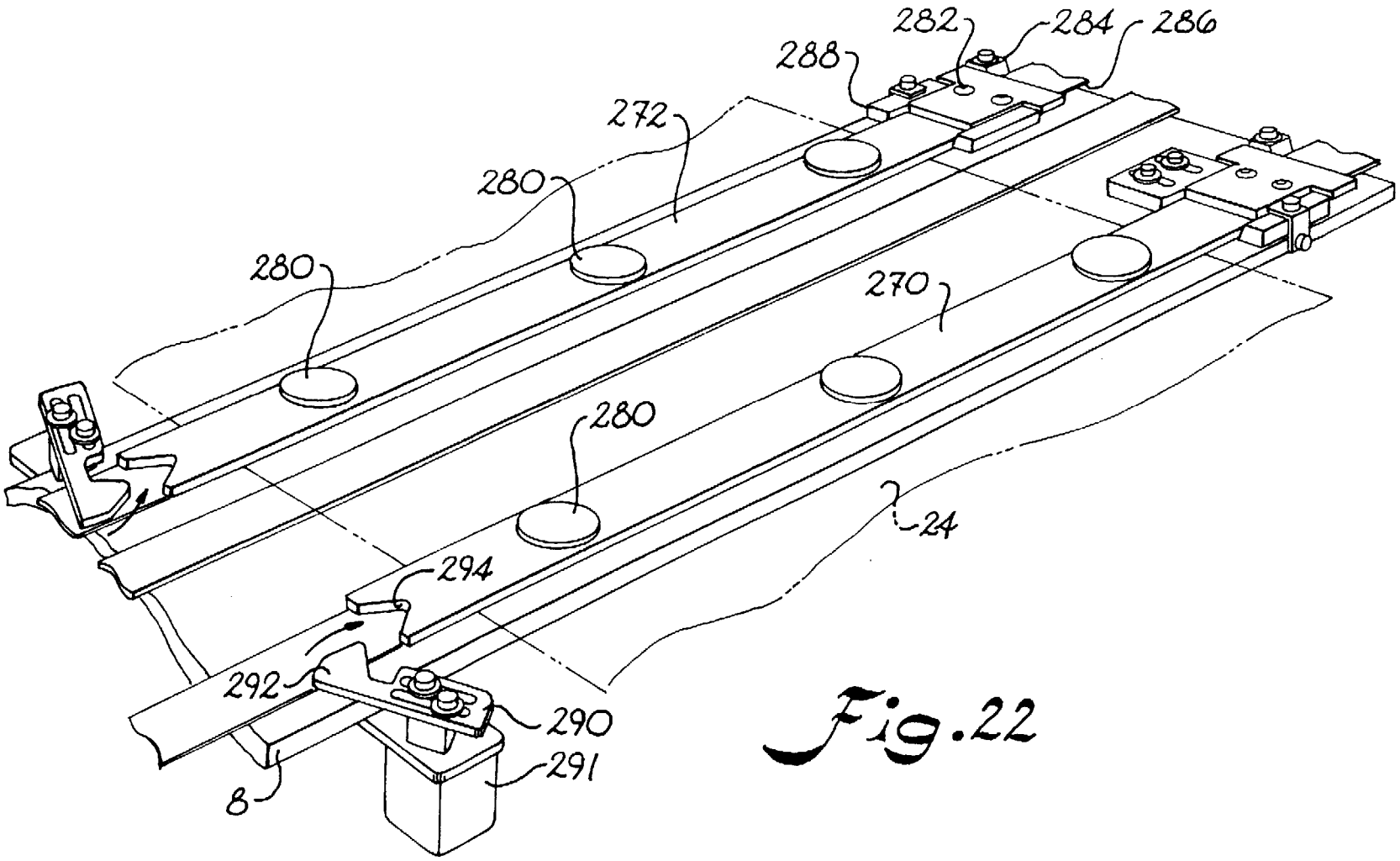
FIG. 22 is an enlarged perspective view illustrating a pair of dies used for holding the cloth down on the folding table during the folding operation.
Figure 24:
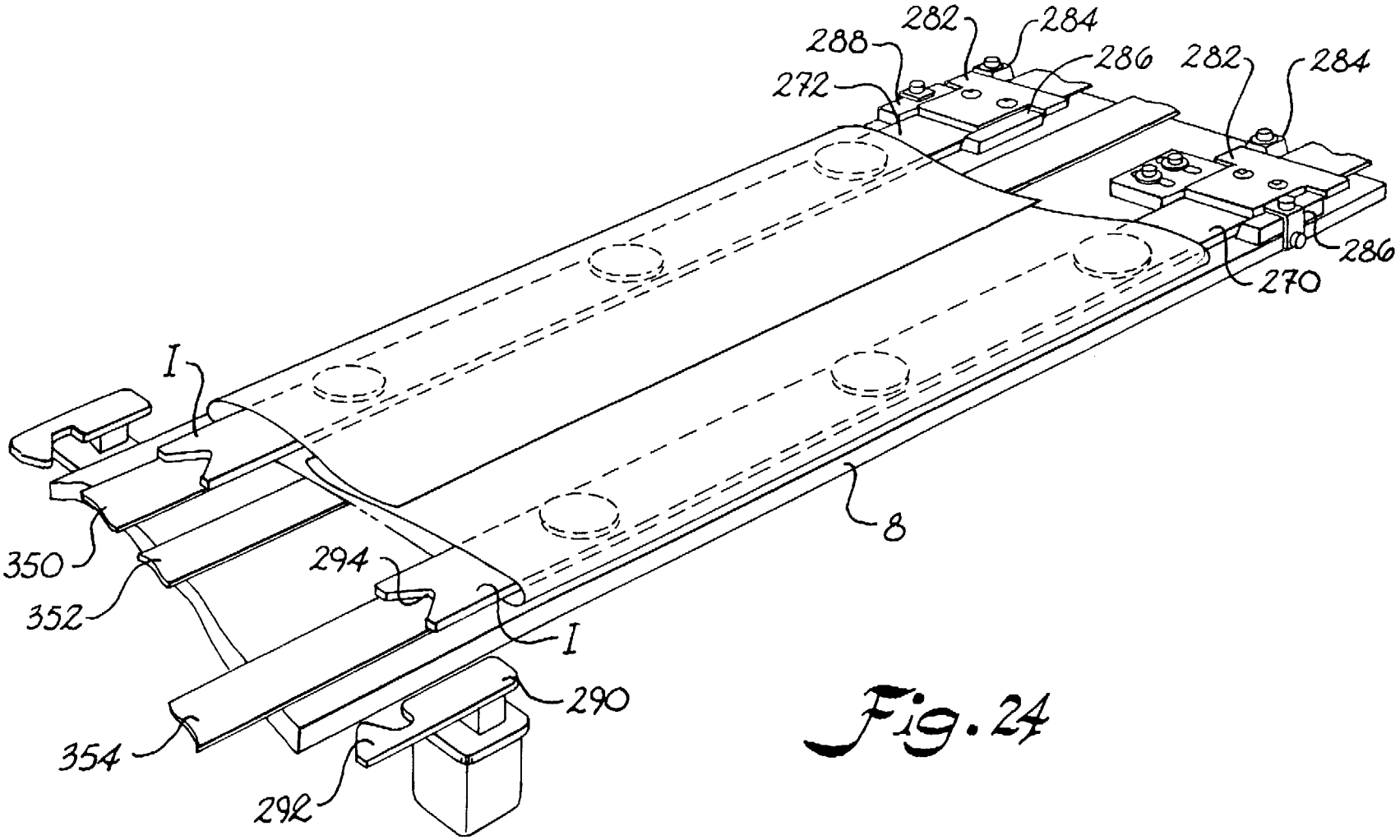
FIG. 24 is an enlarged perspective view illustrating the folded cloth on the folding table prior to sewing.

Before describing the sequence of operation of the pulling head and the folding of the cloth on the folding table, the dies for facilitating the folding of the cloth will be described. The dies include two elongated metal plates 270 and 272 such as best shown in FIGS. 22 and 24. The dies are placed on top of the cloth 24 after the cloth 24 has been pulled onto the folding table 8. The dies are raised and lowered by lifting devices J. The lifting devices J as shown in FIG. 13 include an electrical magnet 274 carried on the end of a piston rod 276 extending out the lower end of a pneumatically operated cylinder 278. The die plates are raised and lowered from the lifting table by manipulating the pneumatically operated cylinders 278. In order to lower the die onto the cloth carried on the table, air is supplied to an upper port of the pneumatic cylinder 278 forcing the piston rod 276 out the lower end of the cylinder. The electromagnet 274 is energized at this time and has the metal die 272 secured thereto. When the die is positioned on top of the cloth, the electromagnet is deenergized releasing the die 272, and the pneumatic cylinder 278 has air supplied to its lower port for raising the piston with the electromagnet upwardly so as not to interfere with the folding operation.

There are three electromagnets positioned above each of the dies for engaging metal plates 280 carried on the dies.

In order to ensure that the dies are properly positioned on the folding table, a T-shaped attachment 282 is carried on one of the ends of each of the dies. The T-shaped attachment is positioned between three abutments 284, 286, and 288, which properly align the end of the die on the folding table 8. Aligning members 290 are provided adjacent to the other end of the dies and include a triangular shaped end portion 292 that is rotated into engagement with a V-shaped recess 294 provided on the end of the dies opposite the end where the T-shaped member 282 is carried. The positioning member 290 is carried on the end of an output shaft of a motor 291 that when energized rotates the engaged member 290 from a retracted position such as shown in FIG. 22 to a positioning position wherein the triangular shaped end portion 292 engages the V-shaped slot 294 to properly align the dies. The T-shaped attachments 282 and aligning members 290 maintain the dies 270 and 272 in their proper position during the folding operation as will be described hereinafter.

Figure 25:
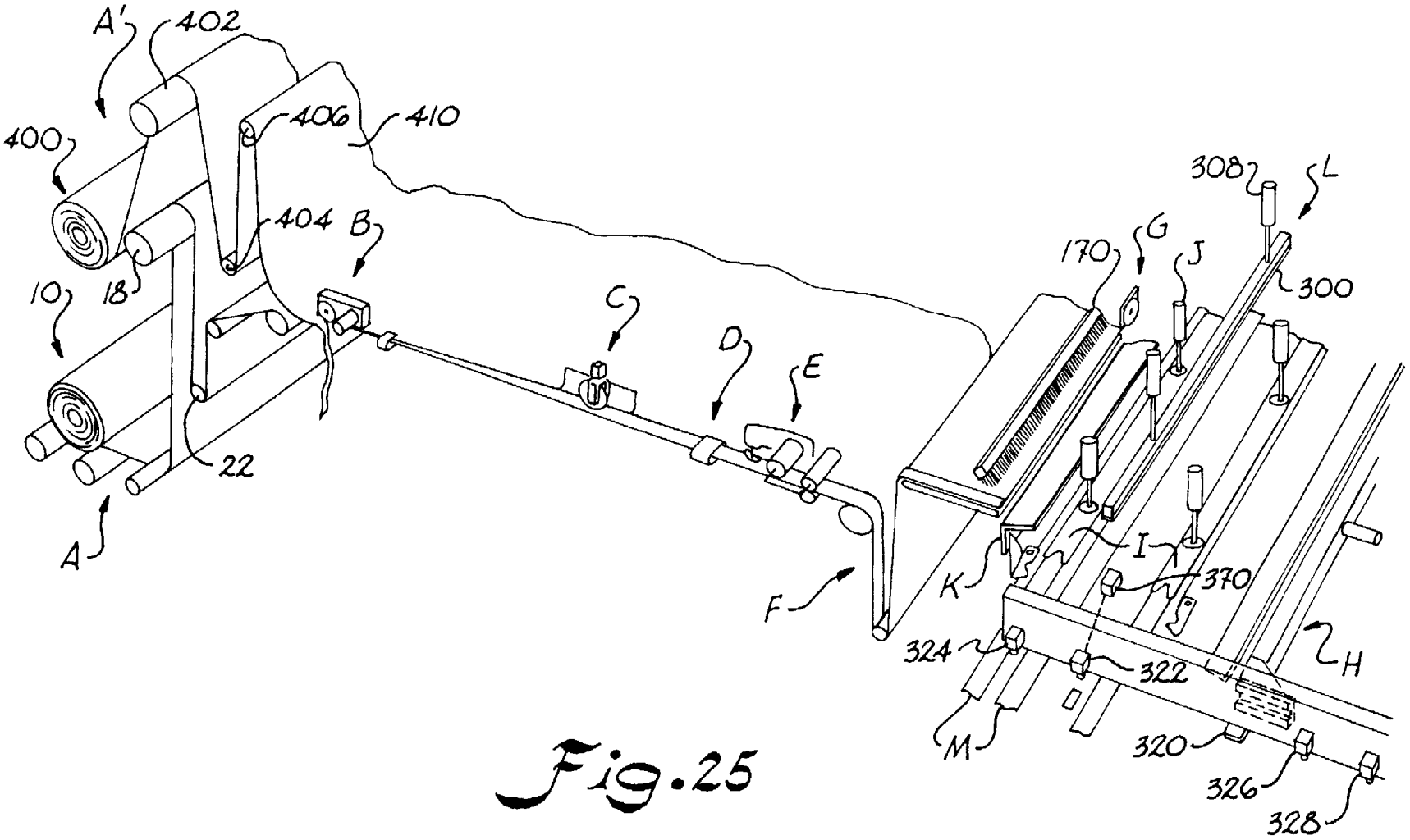
FIG. 25 is a fragmentary perspective view illustrating part of the cloth processing apparatus.

The entire pulling and folding operation of the fabric will be described below, but it is felt that it is best to describe some of the elements that are to be used in the operation before going through the sequences. Another functional device is the cloth hold down device L. The cloth hold down device L as shown in FIGS. 13 and 25 includes an elongated wooden block 300 that extends across the entire folding table 8. Positioned adjacent the bottom of the elongated wooden block 300 is a foam pad 302 that has secured to the bottom surface thereof a strip of high molecular weight polyethylene 304. The elongated block 300 is secured to the lower end of a plurality of pistons 306 that are in turn manipulated by pneumatically operated cylinders 308. The purpose of the cloth hold down bar L is to hold the cloth flush against the folding table when it is desired to transport the folded cloth pattern laterally to a subsequent sewing station. As a result of the foam pad 302, the low friction surface 304 is allowed to ride over seams and hems while imparting a substantially uniform pressure all the way across the cloth. The low friction surface 304 permits the cloth to slide under the hold down device when it is being shifted laterally to a subsequent sewing operation.

Figure 14:
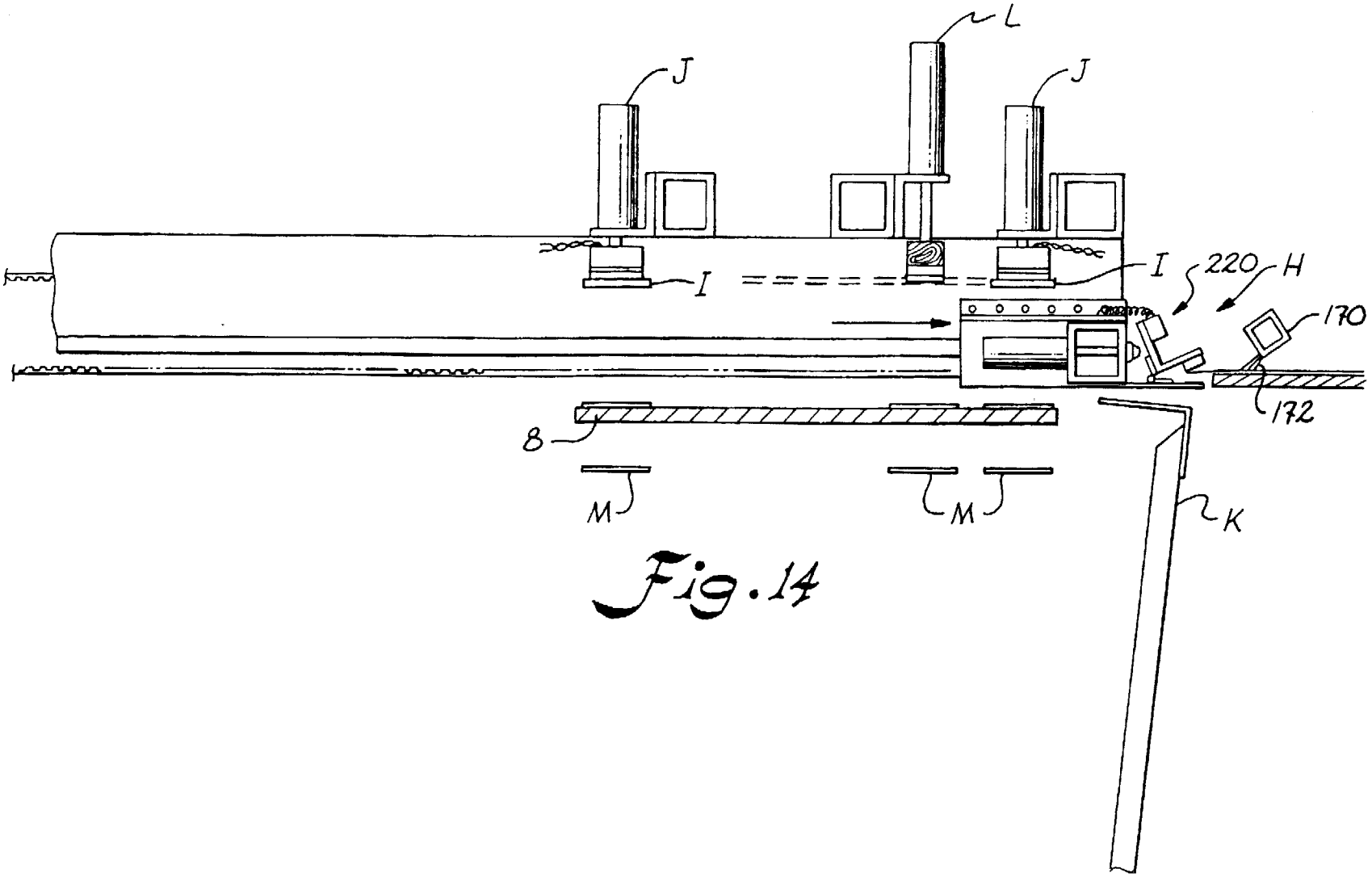
FIG. 14 is an end view illustrating the cloth pulling mechanism in a position immediately prior to gripping the end of the cloth.

This sequence of the pulling and cutting of the predetermined lengths of fabric will now be described. First, reference is directed to FIG. 13 which shows on the right, the edge of the cloth 24 located directly under the cutter blade 206. At this point in time, the cloth puller H is retracted to the end of the machine such as shown in FIG. 13, and the gripping jaw 220 is in an open position. The controller for the machine energizes the drive motor 264 which causes the timing belt 250 to be driven to move the gripping head 220 to the right, to the position shown in FIG. 14. As the gripping head 220 approaches the position shown in FIG. 14, a metal member 320 which is carried by the timing belt 250 and which projects laterally beyond the frame of the machine first passes proximity switch 322 as shown in FIG. 25. At this point in time a signal is generated to slow the motor 264 down. The gripping head 220 continues, however, moving forward until the member 320 is positioned adjacent the proximity switch 324 which generates a signal that is fed back to stop the motor 264 in the position shown in FIG. 14. Note in FIG. 14 that the dies I are engaged with the electromagnets and are in a raised position so as to permit the gripping head to pass thereunder.

Figure 15:
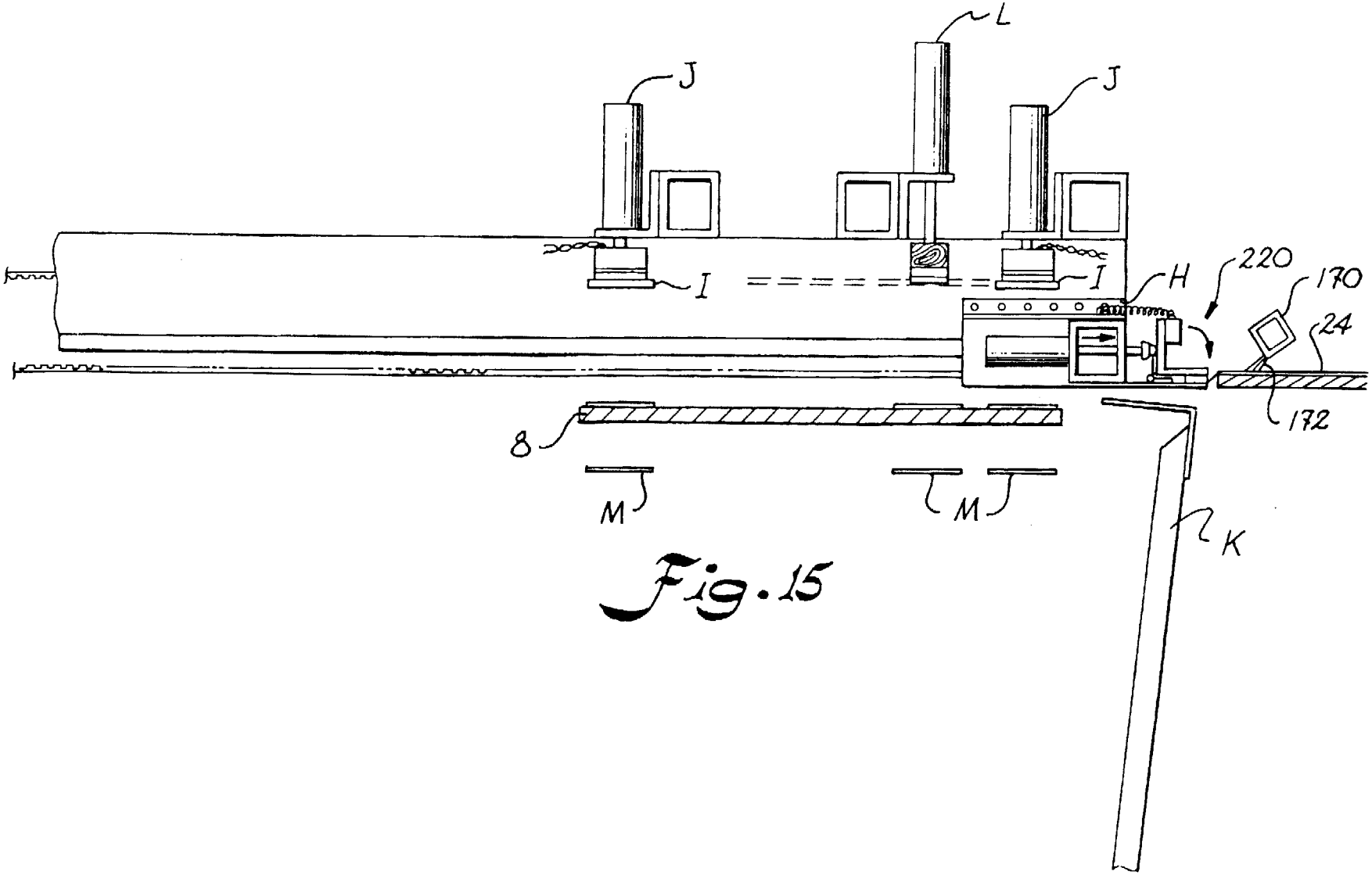
FIG. 15 is an end view partially in section of the cloth pulling mechanism gripping the cloth.

FIG. 15 shows the gripping head 220 lowered to a closed position gripping the leading edge of the fabric 24.

Figure 16:
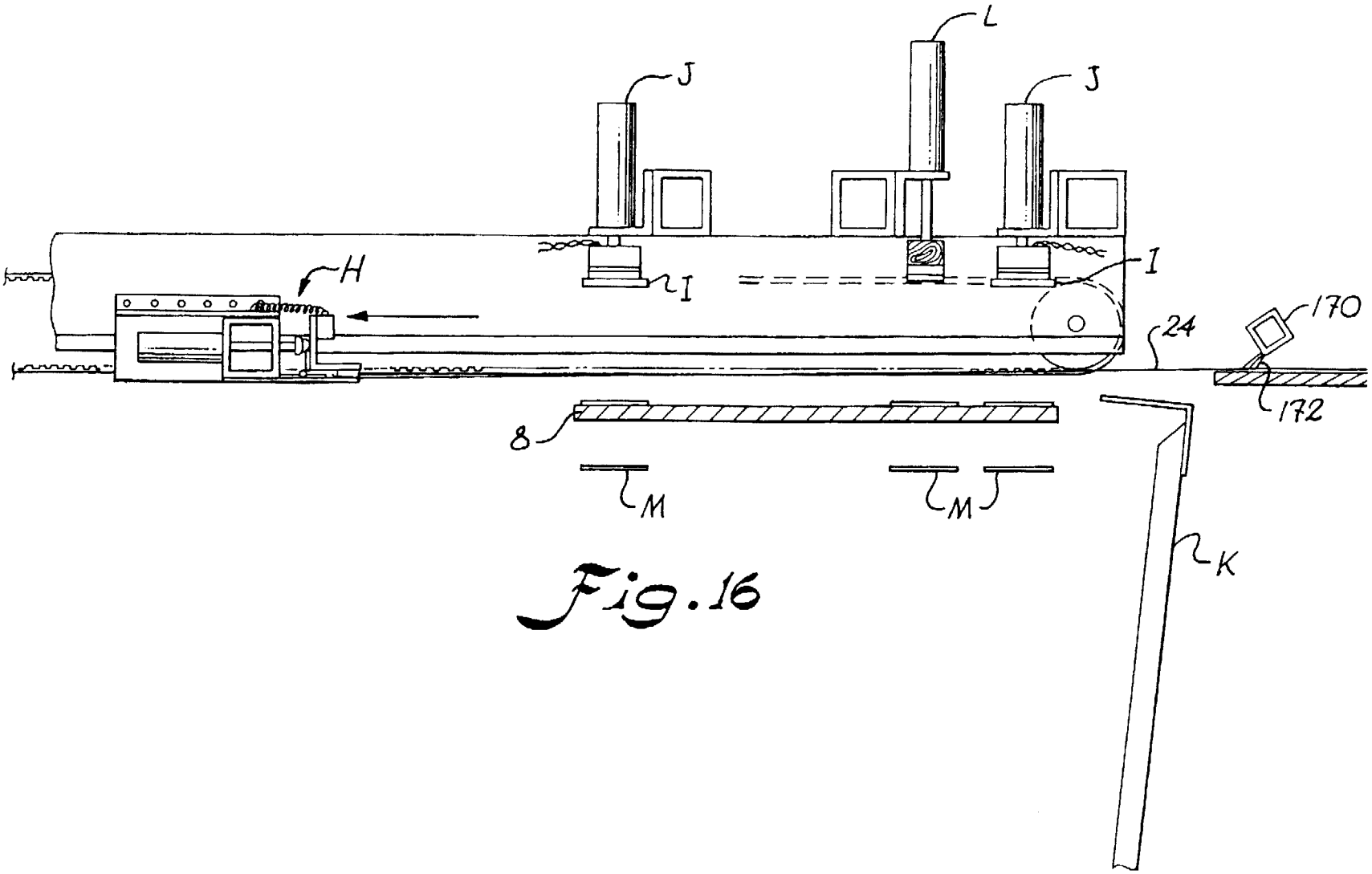
FIG. 16 is an end view of the cloth pulling mechanism after the cloth has been pulled back over the folding table.

In FIG. 16, the controller associated with the machine again energizes the motor 264 to retract the puller H with the gripping head in the closed position pulling the cloth 24 out of the accumulator F. As the activating member 320 carried by the gripping head comes adjacent a proximity switch 326 as shown in FIG. 25, the motor slows down and keeps going backwards until it comes adjacent the proximity switch 328 which stops the motor 264. In this position, the cloth 24 is extended its full length such as shown in FIG. 16. The proximity switches are adjustable for extending the cloth 24 a predetermined distance.

Figure 17:
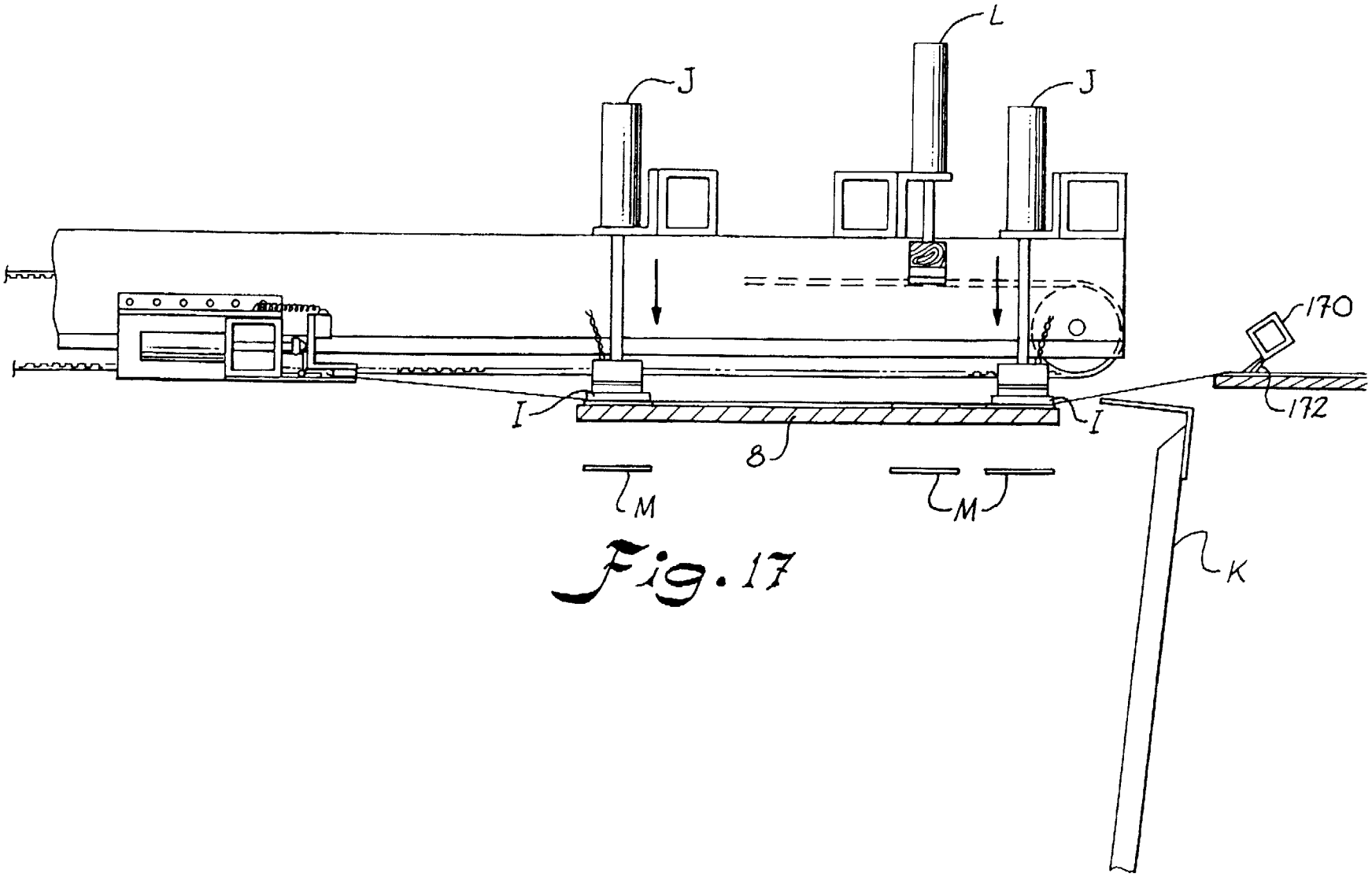
FIG. 17 is an end view of the cloth pulling mechanism and the folding table showing the dies being placed down on the cloth.
Figure 18:
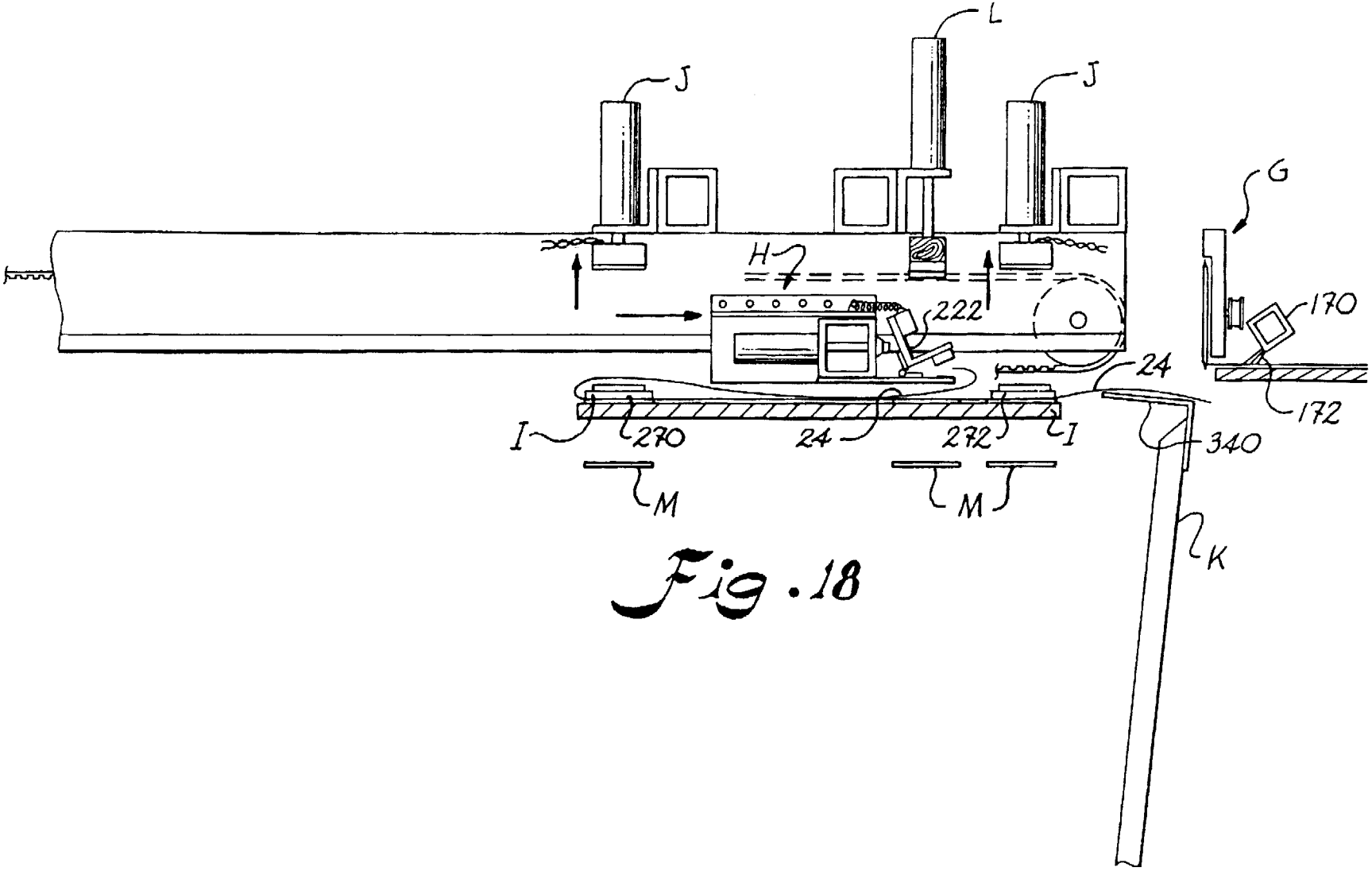
FIG. 18 is an end view illustrating the folding table and the first fold of the fabric forming a folded valance.

The next step in the sequence is activating the pneumatic cylinders forming part of die lifters J to lower the dies I down on top of the folding table 8 as shown in FIG. 17. At this point in time, the electromagnets carried on the end of the pistons associated with the lifting device are deenergized and leave the dies 270 and 272 on top of the extended cloth 24 such as shown in FIG. 22. The cloth puller and leading edge folder H is again moved back to the right as shown in FIG. 18, and while it is moving to the right, it has the leading edge of the cloth engagement between the gripping jaws. When it reaches the position such as shown in FIG. 18, the jaws of the gripping device 220 are open to release the cloth. As can be seen in FIG. 18, a single fold has been made in the cloth at this time.

Figure 19:
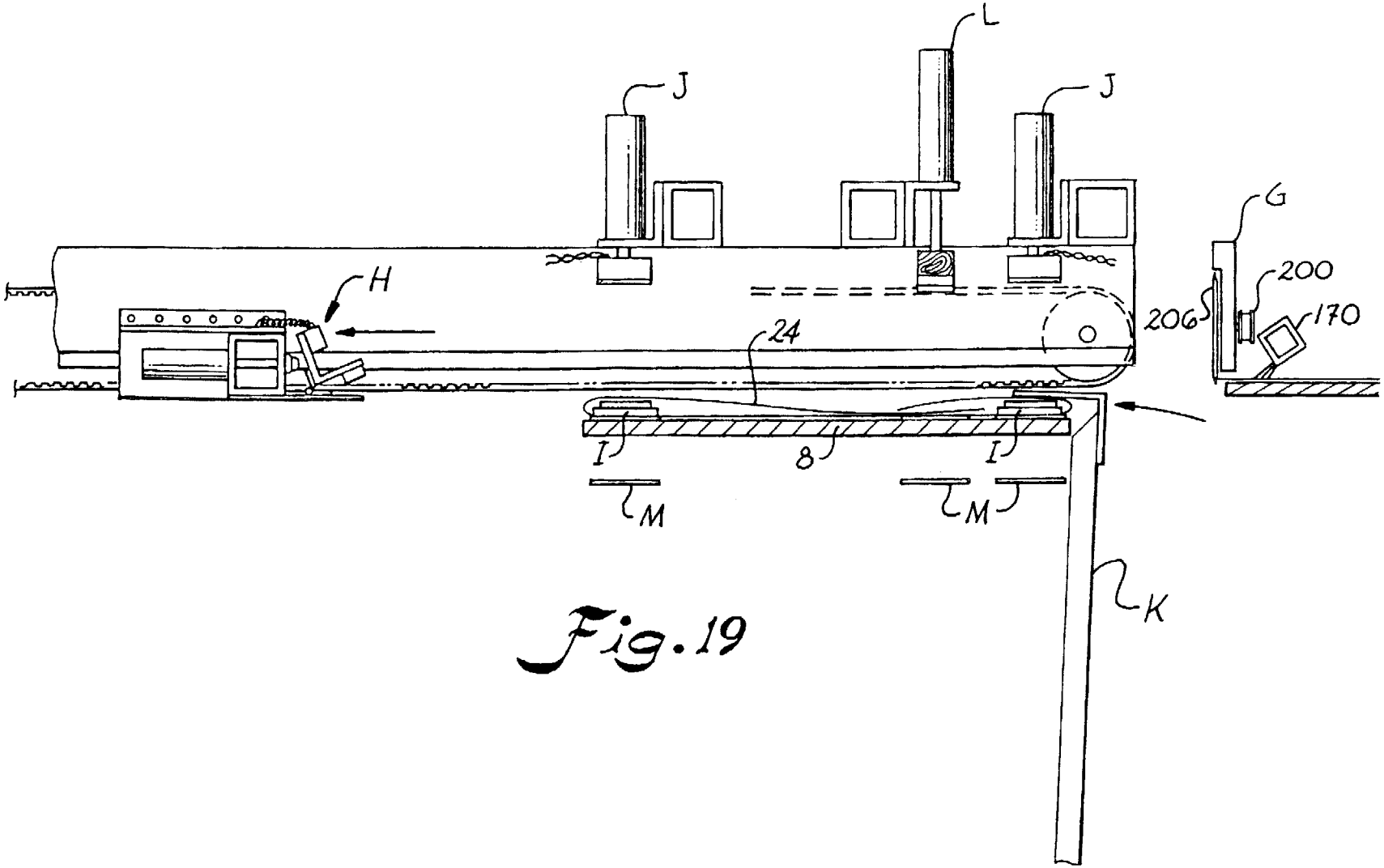
FIG. 19 is an end view illustrating a folding table illustrating the trailing edge of the fabric being folded into a valance.

A trailing end folder K has an L-shaped angled member 340 carried on the upper end thereof which in turn has the trailing end of the fabric 24 resting on top. By pivoting the trailing end folder in the forward direction, the angle member 340 pushes the trailing edge of the fabric over the die 272 to produce the folded pattern such as shown in FIG. 19. This folded pattern is now in position for being transported to a sewing station which will sew a hem in the edge of the upper fold and produce two elongated stitch lines along across the width of the entire valance to define a pocket and a socket in the valance.

Figure 20:
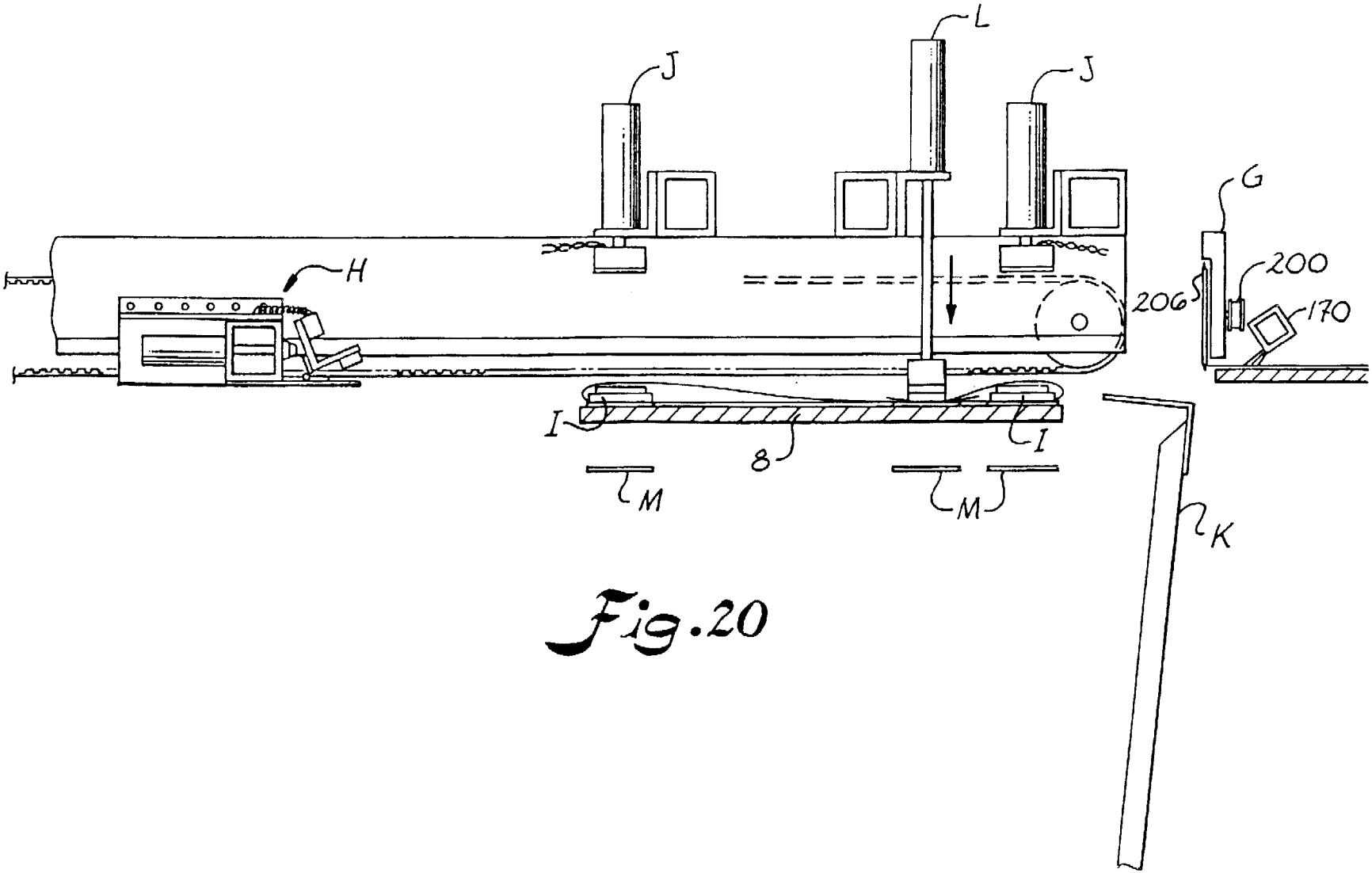
FIG. 20 illustrates an end view of the folding table showing the fabric in a folded condition immediately prior to being transported to a sewing mechanism.

The next step in the sequence is to lower the cloth hold down bar L onto the folded cloth pattern directly above the ends of the cloth as shown in FIG. 20. The cloth shifter M, which is in the form of three driven belts 350, 352, and 354, is used for shifting the folded pattern of cloth laterally from the folding table to an adjacent sewing station. The T-shaped attachments 282 carried on the end of the dies 270 and 272 prevent the dies from being moved laterally as the cloth is pulled by the moving belts 350, 352, and 354, off of the folding table into the next sewing station.

Figure 26:
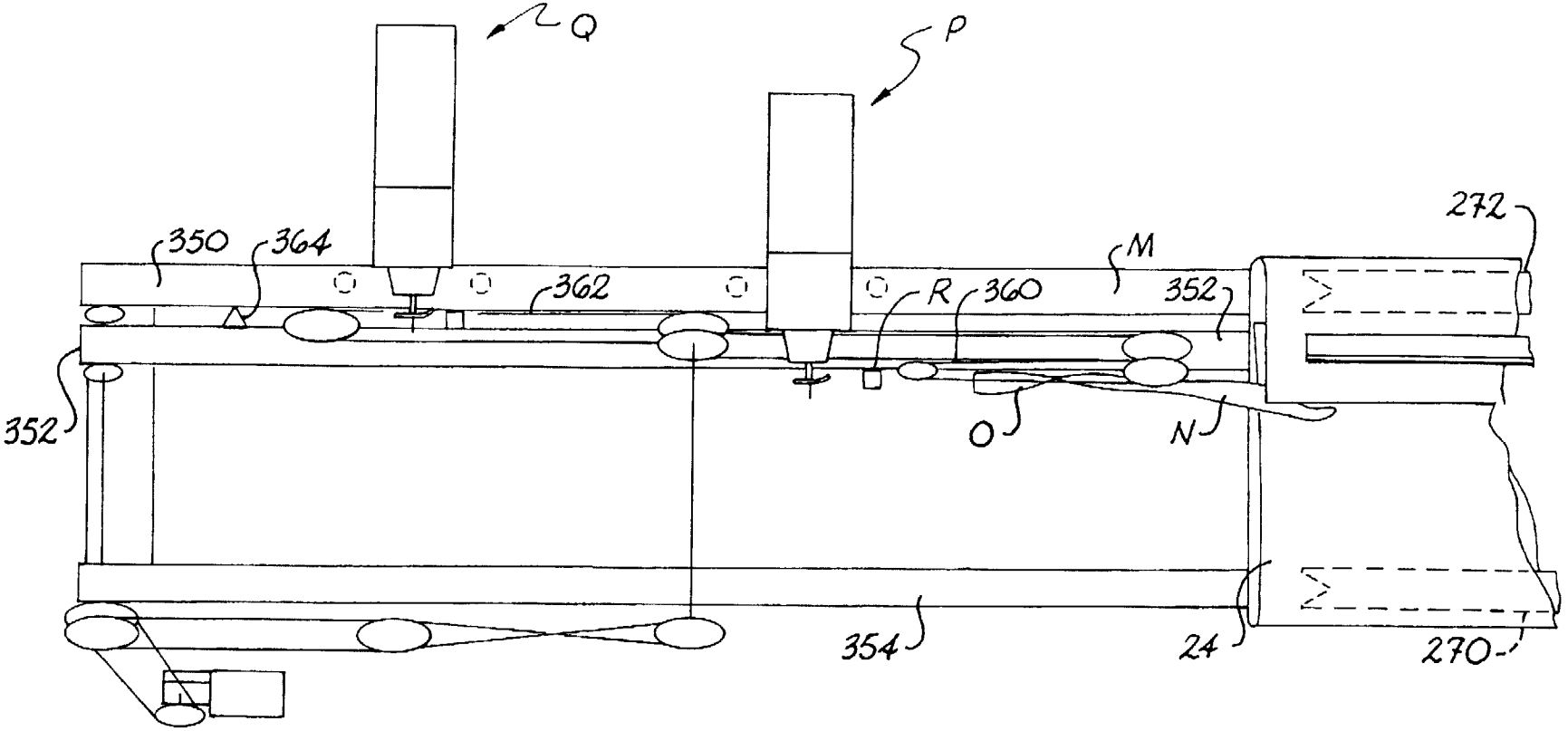
FIG. 26 is a plan view illustrating a final sewing station for sewing valances.

As can be seen in FIG. 26, the folded pattern of cloth 24 is carried on the movable belts 350, 352, and 354. The pattern 24 is held down flush against the belts 352 and 354 by spring loaded plates not shown. The upper edge of the cloth 24 engages a first driven belt 360. Prior to engaging the belt 360, the folded pattern 24 moves into engagement with an edge separating device N which includes a thin upwardly projecting finger that protrudes between the adjacent folds in the pattern of cloth 24 and feeds the edge of the upper fold into a conventional hem edge curler O which curls the edge under to form a hem.

The hem is then fed towards a first sewing machine P which has a single needle.

The purpose of the first sewing head P is to put a length of stitch across the entire folded pattern and to tack stitches adjacent to the leading edge of the valance and the trailing edge of the valance. A second sewing machine Q follows the first sewing machine, and its purpose is to place a stitch continuously across the entire valance. The second sewing head is offset from the first sewing head so that you have offset stitch lines to define a socket for receiving a curtain rod and a pocket for receiving filler material.

A controller is used for controlling the drive of the sewing machines P and Q as well as the drive for the moving belts 350, 352 and 354 and the upper belts 360 and 362.

A photocell R is carried by the first sewing machine P, and it generates a signal indicating that the leading edge of the folded pattern 24 has reached the sewing head. This causes a signal to be sent to the controller which slows down the conveying belts 350, 352 and 354 and the trailing sewing machine Q. The first sewing machine P continues to sew at its normal rate but since the movement of the fabric under the head has been slowed, more stitches per inch are placed in the leading edge of the folded fabric. This occurs for approximately one inch, depending on the preference of the customer.

The same tacking operation takes place at the trailing edge of the folded fabric. The controller can be set for activating the tacking operation according to the lengths of valances being produced.

After the two elongated stitches have been placed across the valances by the sewing heads P and Q, the thread extending between adjacent valances is cut by a thread cutter 364, and the valances are moved off the end of the sewing station onto a rotating folder which folds the valances into a rectangular package.

Proper spacing is maintained between the valances being transferred from the folding table 8 to the final sewing station by means of a photocell 370 that is positioned adjacent to the side of the folding table as shown in FIG. 25. This photocell senses the trailing and leading edges of the folded valances, and activates the controller which starts and stops the conveying and sequencing operation of the machine. Any suitable conventional controller can be used for synchronizing the various conveying and sewing operations taking place.

The apparatus of the present invention can also be adapted to feed two rolls of material simultaneously through the system as can be shown in FIG. 25. The second or top roll of material is placed on the apparatus when it is desirable to have a liner included with the finished product. As shown in FIG. 25, a roll of fabric 400 is carried on a second let off A'. The let off A' includes a power driven roll 402 which has a friction covering thereon. Similar to as described above, power driven roll 402 is driven by an electric motor. The motor is a variable speed driven motor. The speed of the motor can be placed under the control of a dancer roll 404. The dancer roll 404 is permitted to move up and down responsive to variations in tension in the cloth extending therearound. As the dancer roll 404 moves up and down, the voltage applied to the motor drive board is varied for varying the let off speed of the cloth.

However, unlike roll let off A, roll let off A' further includes a second power driven roll 406. Preferably, roll 406 is driven by a slip clutch for varying the torque. Power driven roll 406 is added to let off A' in order to have differential tension on the face fabric in comparison to the liner.

In one embodiment, dancer roll 22 can be set at a particular weight and thus at a constant tension. Dancer roll 404 is then also set at a particular weight. However, by including the second powered roll 406 the tension exerted on the liner 410 can be varied by adjusting the slip clutch engaged with the motor. This adjustment can be made in response to the tension being exerted on the cloth by the sewing heads and cloth advancers E. Once a proper adjustment in the tension of liner 410 is made, the liner 410 and cloth 24 should feed simultaneously and uniformly.

In this arrangement, power roller 406 always applies a continuous torque to liner 410 for placing in equilibrium the rate at which the liner and the cloth are fed to the sewing heads. One type of clutch that can be used in conjunction with the motor used to drive roll 406 is a hysteresis clutch which is well-known in the art. Using a hysteresis clutch, by increasing the voltage, a magnetic field is increased which can be used to vary the torque placed upon roller 406. Of course, other similar types of clutches can be used in the present invention.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to be limitative of the invention so further described in such appended claims.

What is claimed is:

1. A length cutter for laterally cutting a sheet of material comprising:

a cutting head slidably supported upon a horizontal rail having a first end and a second end, said cutting head being laterally moved along said rail and across a sheet of material by a driven belt, said driven belt extending generally from said first end of said horizontal rail to said second end of said rail, said cutting head including a gear arrangement in operative association with a cutting blade, said gear arrangement being in communication with said belt such that when said cutting head is moved across said sheet of material by said belt, said belt simultaneously drives said cutting blade for cutting said material.

2. A length cutter as defined in claim 1, wherein said gear arrangement comprises a pair of idle rollers spaced from a drive roller, said drive roller being operatively connected to said cutting blade, said idle rollers guiding said belt around said drive roller.

3. A length cutter as defined in claim 1, wherein said gear arrangement includes a drive roller connected to said cutting blade, said gear arrangement being configured to rotate said cutting blade in a manner such that the velocity of an edge of said cutting blade is greater than the velocity at which said cutting head is moved along said rail.

4. A length cutter as defined in claim 1, wherein said belt forms a loop extending parallel to said rail and engaging at least one pulley, said at least one pulley being driven by a motor.

5. A length cutter as defined in claim 1, wherein said cutting head moves along said rail in a forward direction and in a reverse direction, said length cutter further comprising a cutting block positioned adjacent to said cutting blade for shearing said sheet of material in either said forward direction or said reverse direction.

6. A length cutter as defined in claim 1, further comprising a leaf spring located adjacent to an edge of said cutting blade for guiding said sheet of material into engagement with said cutting blade.

7. A length cutter as defined in claim 1, wherein said cutting head is attached to said belt.

8. A cutting instrument for cutting a sheet of material comprising:

a cutting head slidably supported upon a horizontal rail adapted to move across and cut a sheet of material in a forward direction and in a reverse direction, said horizontal rail having a first end and a second end, said cutting head comprising a rotating cutting blade interconnected with a drive roller;

a first idle roller and a second idle roller spaced a predetermined distance from said drive roller;

a belt guided by said first and second idle rollers to operatively engage said drive roller such that said belt drives said cutting blade when said cutting head is moved along said horizontal rail, said belt generally extending from said first end to said second end of said horizontal rail; and a cutting block positioned adjacent to said cutting blade for shearing said sheet of material either in said forward direction or said reverse direction.

9. A cutting instrument as defined in claim 8, wherein said first and second idle rollers are spaced said predetermined distance from said drive roller such that a space exists between an outer edge of said drive roller closest to said first and second idle rollers and a plane intersecting an outer edge of said first idle roller and an outer edge of said second outer roller at a point where said idle rollers are closest to said drive roller.

10. A cutting instrument as defined in claim 8, wherein said belt includes a plurality of teeth that mate with a plurality of corresponding teeth located on said drive roller.

11. A cutting instrument as defined in claim 8, wherein said cutting head is suspended below said horizontal rail.

12. A cutting instrument as defined in claim 8, further comprising a leaf spring located adjacent to an edge of said cutting blade for guiding said sheet of material into engagement with said cutting blade.

13. A cutting instrument as defined in claim 8, wherein said cutting head is attached to said belt and said belt is driven by a pulley.

14. A cutting instrument as defined in claim 8, wherein said drive roller is configured in relation to said cutting blade in a manner such that the velocity of an edge of said cutting blade is greater than the velocity at which said cutting head is moved along said rail.

15. A system for processing a roll of material into predetermined lengths of material comprising:

a roll let off for supporting and feeding a roll of material;

a length cutting table for receiving said material from said roll let off, said length cutting table having a determined width; and a cutting instrument for laterally cutting said material comprising a cutting head slidably supported upon a horizontal rail adapted to move across and cut said material in either a forward direction or a reverse direction, said cutting head comprising a rotating cutting blade interconnected with a gear arrangement, said cutting instrument further including a cutting block positioned adjacent to said cutting blade for shearing said sheet of material, and a belt in communication with the said gear arrangement such that when said cutting head is moved along said horizontal rail, said belt engages said gear arrangement causing said cutting blade to rotate, said belt extending across the width of said cutting table.

16. A system as defined in claim 15, wherein said gear arrangement includes a first idle roller and a second idle roller spaced a predetermined distance from a drive roller, said drive roller being operatively connected to said cutting blade, said drive roller including a plurality of teeth that mate with a plurality of corresponding teeth located on said belt.

17. A system as defined in claim 15, wherein said cutting instrument includes a leaf spring positioned adjacent to said cutting blade, said leaf spring guiding said sheet of material into engagement with said cutting blade.

18. A system as defined in claim 15, further comprising a retaining member positioned adjacent to said cutting instrument for retaining said material on said length cutting table after the material has been cut.

19. A system as defined in claim 18, wherein said retaining member comprises a brush-like member including a plurality of bristles adapted to contact and hold said material against said length cutting table.

20. A system as defined in claim 15, wherein said gear arrangement is configured to rotate said cutting blade in a manner such that the velocity of an edge of said cutting blade is greater than the velocity at which said cutting head is moved along said rail.

21. A system as defined in claim 15, wherein said belt forms an endless loop and is attached to said cutting head such that, when said belt is driven, said belt moves said cutting head along said horizontal rail and simultaneously drives said cutting blade.

* * * * *